US005952590A

United States Patent [19]

Kawata et al.

[11] Patent Number: 5,952,590

[45] Date of Patent: Sep. 14, 1999

[54] SINTERED ALLOY HAVING SUPERB WEAR RESISTANCE AND PROCESS FOR PRODUCING THE SAME

[75] Inventors: Hideaki Kawata; Koichiro Hayashi, both of Matsudo; Katsuaki Sato; Tsutomu Saka, both of Wako, all of Japan

[73] Assignees: Hitachi Powdered Metals Co., Ltd., Chiba-ken; Honda Giken Kogyo Kabushiki Kaisha, Tokyo, both of Japan

[21] Appl. No.: 09/016,039

[22] Filed: Jan. 30, 1998

[30] Foreign Application Priority Data

Feb. 3, 1997 [JP] Japan ..... 9-034449

[51] Int. Cl.[6] ..... C22C 33/00

[52] U.S. Cl. ..... 75/231; 75/243; 75/246; 419/10; 419/27

[58] Field of Search ..... 75/243, 246, 231; 419/27, 10

[56] References Cited

U.S. PATENT DOCUMENTS

| | | | |
|---|---|---|---|
| 4,552,590 | 11/1985 | Nakata et al. | 75/246 |
| 4,919,719 | 4/1990 | Abe et al. | 75/243 |
| 5,824,922 | 10/1998 | Aonuma et al. | 75/236 |
| 5,834,664 | 11/1998 | Aonuma et al. | 75/246 |

OTHER PUBLICATIONS

Abstract of Japanese Examined Patent Publication No. 49–17968.

Abstract of Japanese Examined Patent Publication No. 55–36242.

Abstract of Japanese Examined Patent Publication No. 57–56547.

Abstract of Japanese Examined Patent Publication No. 5–55593.

Abstract of Japanese Examined Patent Publication No. 7–56065.

Abstract of Japanese Examined Patent Publication No. 2–280217.

Abstract of Japanese Examined Patent Publication No. 2–280218.

Abstract of Japanese Kokai No. 8–193250.

Abstract of Japanese Kokai No. 1–240637.

Abstract of Japanese Kokai No. 48–70605.

*Primary Examiner*—Ngoclan Mai

*Attorney, Agent, or Firm*—Scully, Scott, Murphy & Presser

[57] ABSTRACT

A sintered alloy having superb wear resistance consisting, percent by weight of, as a whole, Ni in the amount of 1.35 to 19.61%, Cr in the amount of 0.9 to 11.05%, Mo in the amount of 1.44 to 9.09%, Co in the amount of 3.6 to 20.05%, V in the amount of 0.018 to 0.26%, Si in the amount of 0.1 to 0.75%, C in the amount of 0.35 to 1.5%, and the balance of Fe, and the sintered alloy exhibiting a metallographic structure in which the following hard phases are dispersed in a mixed structure of martensite, sorbite, and austenite: a first hard phase comprising, a hard phase as a core mainly consisting of Mo suicide, and a diffused phase including diffused Co surrounding the hard phase; and a second hard phase comprising, a hard phase as a core consisting of Cr carbide, and a mixed phase of ferrite and austenite surrounding the hard phase.

18 Claims, 25 Drawing Sheets

EFFECT OF Mo, V, W IN E ALLOY POWDER

SINTERED ALLOY HAVING SUPERB WEAR RESISTANCE AND PROCESS FOR PRODUCING THE SAME

BACKGROUND OF THE INVENTION

This invention relates to a sintered alloy which exhibits superb wear resistance at elevated temperatures and a process for producing such a sintered alloy. Particularly, the invention relates to the technique suited to be used for a valve seat of internal combustion engines.

Recently, with the progress of higher performance of automobile engines, the conditions for operation became much harder. The valve seat used for such engines is also inevitably required to withstand severer environments than ever. To fulfill such requirements, the present applicant previously proposed several sintered alloys having superb wear resistance as disclosed, for example, in Japanese Examined Patent Publication (KOKOKU) Nos. 17968/74, 36242/80, 56547/82, 55593/93, and 98985/95.

Of all the proposed sintered alloys having superb wear resistance, the alloy disclosed in the Japanese Patent Examined Publication (KOKOKU) No. 56547/82 is improved in the wear resistance. The sintered alloy having such improved wear resistance is produced by preparing, in order to form a matrix for a valve seat, two kinds of alloy powders by alloying all the components contained in the alloys disclosed in the Japanese Patent Examined Publication (KOKOKU) Nos. 17968/74 and 36242/80 only excepting the graphite, then mixing a graphite powder to the alloy powders thus prepared, and then forming and sintering the mixed powder so that a porphyritic matrix structure will be exhibited. Specifically, graphite is added to a mixed powder of A alloy powder consisting, percent by weight, of Cr in the amount of 2 to 4%, Mo in the amount of 0.2 to 0.4%, V in the amount of 0.2 to 0.4%, and the balance of Fe, and B alloy powder consisting, percent by weight, of Ni in the amount of 0.5 to 3%, Mo in the amount of 0.5 to 3%, Co in the amount of 5.5 to 7.5%, and the balance of Fe to set the weight ratio between the A alloy powder and the B alloy powder to 25:75 to 75:25. By doing so, the wear resistance is improved.

The sintered alloy having superb wear resistance disclosed in the Japanese Patent Examined Publication (KOKOKU) No. 55593/93 exhibits a structure obtained by dispersing a hard phase consisting, percent by weight, of Mo in the amount of 26 to 30%, Cr in the amount of 7 to 9%, Si in the amount of 1.5 to 2.5% and the balance of Co to the alloy disclosed in the Japanese Patent Examined Publication (KOKOKU) No. 36242/80. The sintered alloy having such a structure can be produced by compacting and sintering a mixed power of the B alloy powder, C alloy powder consisting, percent by weight, of Mo in the amount of 26 to 30%, Cr in the amount of 7 to 9%, Si in the amount of 1.5 to 2.5%, and the balance of Co, and a graphite powder. The sintered alloy having superb wear resistance disclosed in the Japanese Patent Examined Publication (KOKOKU) No. 98985/95 is an improvement of the alloy disclosed in the Japanese Patent Examined Publication (KOKOKU) No. 55593/93. By containing the alloy of the Publication (KOKOKU) No. 55593/93 with Ni in the amount of 5 to 27% by weight, the matrix structure is strengthened.

As apparent from the foregoing, the present applicant proposed several sintered alloys having superb wear resistance in order to meet with the requirements of the age. However, the present situation is that the conditions for operation are even increased in severeness as the performance of automobile engines is further improved and that the material, which is superior in wear resistance and in strength at elevated temperatures to the aforementioned sintered alloys, is demanded.

For instance, in the LPG fuel engine loaded on taxicabs, the contact surfaces between the valve and the valve seat are dry in use. For this reason, the valve seat of the LPG fuel engine is worn more quickly than the valve seat of the gasoline engine. In the environments where sludge is liable to attach as in the lead-contained gasoline engine, in case the surface pressure with respect to the valve seat is high, or in case of a high temperature/high compression ratio as in the diesel engine, the wear is further promoted by sludge. For the use in such hard environments, in addition to the superb wear resistance, a physical strength large enough to prevent permanent set in fatigue is demanded.

On the other hand, a valve gear mechanism having a rush adjuster mechanism capable of automatically adjusting the position of the valve and the timing for driving the valve even in a worn condition of the valve seat, is already put into actual practice. However, the problem associated with the service life of the engine due to wear of the valve seat is not yet obviated. Also in view of the strong demand for lowering the cost, the development of a valve seat material having superb wear resistance is demanded.

The development of automobiles of the recent year is directed not only to higher performance but also to lower cost from an economical view point. For this reason, the sintered alloy for such valve seats are required to have superb wear resistance at elevated temperatures and large physical strength without a need of additional mechanisms mentioned above.

The present invention has been accomplished in view of the above-mentioned situation.

SUMMARY OF THE INVENTION

It is, therefore, a general object of the present invention to provide a sintered material which is large in physical strength and superb in wear resistance at elevated temperatures.

The first sintered alloy having superb wear resistance according to the present invention relates to an improvement of a sintered alloy having superb wear resistance which is previously disclosed by the present applicant. This sintered alloy based on, as a matrix structure, the alloy disclosed in the Japanese Patent Examined Publication (KOKOKU) No. 56547/82, i.e., the alloy exhibiting a porphyritic metallographic structure by the A alloy powder and the B alloy powder, then, in order to strengthen the matrix, Ni is added thereto, and in addition, two kinds of alloy powders, namely, the C alloy power used in the Japanese Patent Examined Publication (KOKOKU) Nos. 55593/93 and 98985/95 and the D alloy powder consisting of Cr in the amount of 4 to 25% by weight and the balance of Fe, which is discovered by the present inventors, are further added thereto to form a hard phase.

Specifically, the first sintered alloy having superb wear resistance according to the present invention is characterized by consisting, percent by weight of, as a whole:

Ni in the amount of 1.35 to 19.61%;

Cr in the amount of 0.9 to 11.05%;

Mo in the amount of 1.44 to 9.09%;

Co in the amount of 3.6 to 20.05%;

V in the amount of 0.018 to 0.26%;

Si in the amount of 0.1 to 0.75%;

C in the amount of 0.35 to 1.5%; and the balance of Fe; and the sintered alloy exhibiting a metallographic structure in which the following hard phases are dispersed in a mixed structure of martensite, sorbite, and austenite:

a first hard phase comprising, a hard phase as a core mainly consisting of Mo silicide, and a diffused phase including diffused Co surrounding the hard phase; and a second hard phase comprising, a hard phase as a core consisting of Cr carbide, and a mixed phase of ferrite and austenite surrounding the hard phase.

Effects of the sintered alloy having superb wear resistance thus constructed, as well as the ground for the numerical limitation, will now be described with reference to FIG. 1.

① Matrix

FIG. 1 is a schematic view showing a metallographic structure of the sintered alloy having superb wear resistance, whose surface is subjected to corrosion treatment by nital or the like. As shown in FIG. 1, the matrix for this sintered alloy has a mixed structure of martensite, sorbite, and austenite. The martensite is hard, physically strong, and capable of contributing to the improvement of the wear resistance. However, because of the hardness, it promotes the wear of the valve as its counterpart component element. Therefore, by dispersing sorbite having less hardness than martensite and austenite having rich toughness, superb wear resistance is applied to the matrix and at the same time, the counterpart component element is less damaged.

② First Hard Phase

As shown in FIG. 1, the matrix is dispersed therein with a first hard phase comprising, a hard phase as a core mainly consisting of Mo silicide, and a diffused phase including diffused Co surrounding the hard phase. Because the diffused phase is high in the density of Co and looks white when observed through a metallurgical microscope, it is indicated as a while phase in FIG. 1. This first hard phase is further improved in the wear resistance because of the presence of the hard Mo silicide.

③ Second Hard Phase

As shown in FIG. 1, the matrix is dispersed therein with a second hard phase comprising, a hard phase as a core consisting of Cr carbide, and a mixed phase of ferrite and austenite surrounding the hard phase. Although the second hard phase is less hard than the first hard phase, it further improves, when it is present together with the first hard phase, the wear resistance which can be obtained only by the first hard phase. That is, the wear resistance is of course improved by forming the second hard phase. In addition, the second hard phase is rich in the toughness and serves to increase the material strength because the mixed phase of austenite and ferrite is high in the density of Cr. Moreover, the wear resistance is further improved by diffusing the Cr carbide of the second hard phase in the matrix.

The ground for the numerical limitation of the above-described chemical composition is described hereinafter.

Ni: Ni can dissolve (solid solution) in the matrix to strengthen the matrix, thereby contributing to the improvement of the wear resistance. It also serves to improve the hardening property of the structure of the matrix, thereby promoting martensite transformation. Furthermore, Ni is diffused to the matrix so as to be dissolved into the matrix to strengthen the matrix. The portion where Ni is high in density is remained as soft austenite, thereby improving the toughness of the matrix. If the content of Ni is less than 1.35% by weight, the above-mentioned effects are insufficiently obtained. In contrast, if it is more than 19.61% by weight, the amount of the soft austenite phase is increased, so that the wear resistance is deteriorated and the powder is hardened to thereby deteriorate the compacting property. For this reason, the content of Ni is limited to the range of from 1.35 to 19.61% by weight.

Cr: Cr can dissolve (solid solution) into the matrix to strengthen the matrix and improve the hardening property of the structure of the matrix. Owing to this function, Cr contributes to both the physical strength and the wear resistance of the matrix. Further, Cr forms the second hard phase comprising a hard phase as a core consisting of Cr carbide, thereby further improving the wear resistance. Moreover, Cr diffused into the matrix from the first and second hard phases has such functions as to bind the first and second hard phases firmly to the matrix, to further strengthen the structure of the matrix and to further improve the hardening property. Portion around the second hard phase where Cr is high in the density forms a mixed phase of ferrite and austenite, so that the effects for absorbing a shock when the valve is seated and for preventing the escape of the hard components such as Cr carbide, etc. from the contact surfaces. If the content of Cr is less than 0.9% by weight, the abovementioned effects are insufficiently obtained. In contrast, if it is more than 11.05% by weight, the powder is hardened to deteriorate the compacting property. For this reason, the content of Cr is limited to the range from 0.9 to 11.05% by weight.

Mo: Mo can dissolve (solid solution) into the matrix to strengthen the matrix and improve the hardening property of the structure of the matrix. Owing to such functions, it contributes to the physical strength and the wear resistance of the matrix. Mo mainly forms a hard Mo silicide together with Si, and partly reacts with Co to form a Mo—Co silicide. By forming a core of the first hard phase in this way, it contributes to the improvement of the wear resistance. If the content of Mo is less than 1.44% by weight, the improvement of the physical strength of the matrix is insufficiently obtained and a sufficient amount of silicide is not precipitated. In contrast, if it is more than 9.09% by weight, the powder is hardened to deteriorate the compacting property and the amount of the silicide is increased to thereby promote the wear of the counterpart component element. For this reason, the content of Mo is limited to the range of from 1.44 to 9.09% by weight.

Co: Co can dissolve (solid solution) into the matrix to improve the heat resistance of the matrix. It also serves to improve the physical strength at elevated temperatures and to improve the wear resistance at elevated temperatures. Co of the first hard phase is diffused to the matrix so as to be dissolved into the matrix and serves to bind the first hard phase firmly to the matrix. Further, Co diffused into the matrix serves to strengthen the matrix and to improve the heat resistance of both the matrix and the hard phase matrix. In addition, part of Co forms Mo—Co silicide together with Si and contributes to the improvement of the wear resistance as a core of the first hard phase. If the content of Co is less than 3.6% by weight, the above-mentioned effects are insufficiently obtained. In contrast, if it is more than 20.05% by weight, the powder is hardened to deteriorate the compacting property. For this reason, the content of Co is limited to the range of from 3.6 to 20.05% by weight.

V: V can dissolve (solid solution) into the matrix to strengthen the matrix and to improve the wear resistance thereof. If the content of V is less than 0.018% by weight, the above-mentioned effects are insufficiently obtained. In contrast, if it is more than 0.26% by weight, the powder is hardened to deteriorate the compacting property. For this reason, the content of V is limited to the range of from 0.018 to 0.26% by weight.

Si: As previously mentioned, Si is combined with Mo and Co to form a hard Mo silicide and a hard Mo—Co silicide, thereby to contribute to the improvement of the wear resistance. If the content of Si is less than 0.1% by weight, a sufficient amount of silicide is not precipitated. In contrast, if it is more than 0.75% by weight, the powder is hardened to deteriorate the compacting property and the amount of formed suicide is increased to promote the wear of the counterpart component element. For this reason, the content of Si is limited to the range of from 0.1 to 0.75% by weight.

C: C serves to strengthen the matrix and contributes to the improvement of the wear resistance. Also, C forms Cr carbide to further contribute to the improvement of the wear resistance. If the content of C is less than 0.35%, ferrite, which is low in both the wear resistance and the physical strength, remains in the structure of the matrix and the carbide is insufficiently formed to thereby deteriorate the improvement of the wear resistance. In contrast, if it is more than 1.5% by weight, cementite begins to precipitate at the grain boundary to decrease the strength and the amount of formed carbide is increased to promote the wear of the counterpart component element. Moreover, the powder is hardened to deteriorate the compacting property. For this reason, the content of C is limited to the range of from 0.35 to 1.5% by weight.

The second sintered alloy having superb wear resistance according to the present invention, is characterized by employing E alloy powder instead of the D alloy powder, the E alloy powder consisting, percent by weight, of Cr in the amount of 4 to 25%, C in the amount of 0.25 to 2.4%, at least one or two of Mo in the amount of 0.3 to 3%, V in the amount of 0.2 to 2.2%, and W in the amount of 1 to 5%, and the balance of Fe.

Specifically, the second sintered alloy having superb wear resistance is characterized by consisting, percent by weight of, as a whole:

Ni in the amount of 1.35 to 19.61%;

Cr in the amount of 0.9 to 11.05%;

Mo in the amount of 1.44 to 9.42%;

Co in the amount of 3.6 to 20.05%;

V in the amount of 0.018 to 0.85%;

W in the amount of 0 to 1.50%;

Si in the amount of 0.1 to 0.75%;

C in the amount of 0.35 to 1.5%; and the balance of Fe; and the sintered alloy exhibiting a metallographic structure in which the following hard phases are dispersed in a mixed structure of martensite, sorbite, and austenite:

a first hard phase comprising, a hard phase as a core mainly consisting of Mo silicide, and a diffused phase including diffused Co surrounding the hard phase; and a second hard phase comprising, a hard phase as a core mainly consisting of Cr carbide as a main component, and a mixed phase of ferrite and austenite surrounding the hard phase.

In the sintered alloy having superb wear resistance thus constructed, by setting the uppermost limit of the addition amounts of Mo and V larger and adding W in accordance with necessity, the hard particles in the second hard phase consist of, in addition to Cr carbide, Mo carbide, V carbide, W carbide, and an intermetallic compound of Cr and Mo, V or W. That is, it has a metallographic structure in which the core consisting of Cr carbide in the schematic view of FIG. 1 is replaced by a core consisting of Cr carbide as a main component. V and W form fine carbide with C to contribute to the improvement of the wear resistance, and the intermetallic compound and the carbide have the effects for preventing the Cr carbide from become more coarse. Because the coarse Cr carbide promotes the wear of the counterpart component element, the wear of the valve as a counterpart component element is reduced by such preventive means and the wear resistance is improved. Therefore, the second sintered alloy having superb wear resistance according to the present invention has, as a matter of course, the above-mentioned excellent characteristics, and in addition, it is further improved in the wear resistance.

The reason why the uppermost limits of Mo, V and W are hereby set to 9.42% by weight, 0.85% by weight, and 1.50% by weight, respectively, is that if they are more than the uppermost limits, respectively, the powder is hardened to deteriorate the compacting property and the precipitated intermetallic compound and the carbide are increased in the amount to promote the wear of the counterpart component element. For this reason, in the second sintered alloy having superb wear resistance, the content of Mo is limited to the range of from 1.44 to 9.42% by weight, and the content of V is limited to the range of from 0.018 to 0.85% by weight. The ground for setting the lowermost limits of the contents of Mo and V is the same as the first sintered alloy having superb wear resistance. In order to positively form the intermetallic compound and the carbide mentioned above, it is preferred that the content of Mo is 1.51% by weight or more, the content of V is 0.038% by weight or more, and the content of W is 0.05% by weight or more. The contents of the remaining components are the same as the first sintered alloy having superb wear resistance and the grounds for setting the uppermost and lowermost limits are the same, too.

It is preferred that at least one of lead, manganese sulfide, boron nitride, and meta-magnesium silicate metal is dispersed in the amount of 0.3 to 2.0% by weight in the metallographic structure of the first and the second sintered alloy having superb wear resistance. They are the components for improving the machinability and therefore, serve as a initiating point for chip breaking when a cutting is carried out, thereby enabling to improve the machinability of the sintered alloy. If the contents of the components for improving the machinability are less that 0.3% by weight, the effects are insufficiently obtained. In contrast, if they are more than 2.0% by weight, the physical strength of the sintered alloy is deteriorated. For this reason, the contents are limited to the range of from 0.3 to 2.0% by weight.

It is preferred that pores formed in the sintered alloy contain lead, acrylic resin, or copper or copper alloy. They are also the components for improving the machinability. Particularly, when a sintered alloy having pores are cut, it is cut intermittently. However, by having the pores contain lead or copper, such a sintered alloy can be cut in a consecutive manner and a shock applicable to the edge of the cutting tool is eased. The lead serves as a solid lubricant. Since the copper or copper alloy is high in the thermal conductivity, it prevents the heat from being internally confined, so that the edge of the cutting tool can be less damaged by heat. The acrylic resin serves as a initiating point of chip breaking in a cutting operation.

The first process for producing a sintered alloy having superb wear resistance according to the present invention is characterized by comprising:

preparing the following alloy powders,

A alloy powder consisting, percent by weight, of Cr in the amount of 2 to 4%, Mo in the amount of 0.2 to 0.4%, V in the amount of 0.2 to 0.4%, and the balance of Fe;

B alloy powder consisting, percent by weight, of Ni in the amount of 3% or less, Mo in the amount of 0.5 to 3%, Co in the amount of 5.5 to 7.5%, and the balance of Fe;

C alloy powder consisting, percent by weight, of Mo in the amount of 26 to 30%, Cr in the amount of 7 to 9%, Si in the amount of 2 to 3%, and the balance of Co; and D alloy powder consisting, percent by weight, of Cr in the amount of 4 to 25%, C in the amount of 0.25 to 2.4%, and the balance of Fe;

adding, percent by weight, a Ni powder in the amount of 3 to 20%, and a graphite powder in the amount of 0.6 to 1.2% to the A alloy powder and the B alloy powder whose mutual weight ratio is 25:75 to 75:25 so as to be turned into a preliminarily mixed powder (the weight ratio is with respect to the preliminarily mixed powder as a whole); and using a mixed powder obtained by adding the C alloy powder in the amount of 5 to 25% by weight, and the D alloy powder in the amount of 5 to 30% by weight to the preliminarily mixed powder (the weight ratio is with respect to the mixed powder as a whole).

The reasons for limiting the ratio of the components of each powder and each component are described.

(1) Preliminarily Mixed Powder

A Alloy Powder

Cr: Cr is an element that can dissolve (solid solution) into the matrix to strengthen the matrix, thereby improving the wear resistance and improving the hardening property of the structure of the matrix. If the content of Cr contained in the A alloy powder is less than 2% by weight with respect to the weight of the A alloy powder, the above-mentioned effects are insufficiently obtained. In contrast, if it is more than 4% by weight, the powder is hardened to deteriorate the compacting property. For this reason, the content is limited to the range of from 2 to 4% by weight.

Mo and V: Mo and V can dissolve (solid solution) into the matrix to strengthen the matrix, thereby increasing the strength of the matrix. If the contents of Mo and V contained in the A alloy powder are each less than 0.2% by weight with respect to the weight of the A alloy powder, the effects are insufficiently obtained. If they are each more than 0.4% by weight, the powder is hardened to deteriorate the compacting property. For this reason, the contents of Mo and V are each limited to the range of from 0.2 to 0.4% by weight.

B Alloy Powder

Ni: Ni is an element that can dissolve (solid solution) into the matrix to strengthen the matrix, thereby improving the wear resistance and improving the hardening property of the structure of the matrix. If the content of Ni contained in the B alloy powder is more than 3% by weight with respect to the weight of the B alloy powder, the powder is hardened to deteriorate the compacting property. For this reason, the content is limited to 3% by weight or less. Because Ni is added to the preliminarily mixed powder in the form of single powder in this process, the content of Ni contained in the B alloy powder may be zero (0).

Mo: Mo is an element that can dissolve (solid solution) into the matrix to strengthen the matrix, thereby increasing the physical strength and improving the hardening property. If the content of Mo contained in the B alloy powder is less than 0.5% by weight with respect to the weight of the B alloy powder, the effects are poorly obtained. In contrast, if it is more than 3% by weight, the powder is hardened to deteriorate the compacting property. For this reason, the content is limited to the range of from 0.5 to 3% by weight.

Co: Co is an element that can dissolve (solid solution) into the matrix to improve the heat resistance and to increase both the physical strength and the wear resistance at elevated temperatures. If the content of Co contained in the B alloy powder is less than 5.5% by weight with respect to the weight of the B alloy powder, the effects are insufficiently obtained. In contrast, if it is more than 7.5% by weight, the power is hardened to deteriorate the compacting property. For this reason, the content is limited to the range of from 5.5 to 7.5% by weight.

Weight Percent of A Alloy Powder and B Alloy Powder

The structure using the A alloy powder is harder in the matrix than the structure using the B alloy powder. In order to improve the wear resistance, however, it is more effective that the hardness of the structure is porphyritic and portion having different hardness exists rather than the hardness is uniform. By using a mixture of two kind of alloy powder, there can be obtained a structure in which portions having different hardness are dispersed in a porphyritic pattern. According to the study made by the inventors, it is found out that the wear resistance is more improved when the weight percent of the A alloy power and the B alloy powder is in the range of from 25:75 to 75:25 compared with the weight percent when the structure of the matrix is formed by only the A alloy powder or the B alloy powder, and that if the weight percent departs from this range, the wear resistance is not improve or deteriorated in some cases. For this reason, the weight percent of both the powders is limited to the range of from 25:75 to 75:25.

Ni Powder

Since only the structure of the matrix comprising the A alloy power and the B alloy powder cannot meet with the requirement for the higher output power of the engines of the present day, Ni is added in the form of single powder in order to strengthen the matrix. Ni is diffused to the matrix so as to be dissolved (solid solution) into the matrix to strengthen the matrix and to improve the hardening property of the structure of the matrix. By doing so, martensite of the matrix is promoted thereby to improve the wear resistance. Portion of the matrix where Ni is high in density remains as austenite thereby to improve the toughness of the matrix.

It should be noted that Ni may be added in a form of pre-alloy to the A alloy powder, or the B alloy powder, or both the A alloy powder and the B alloy powder. The term "pre-alloy" used herein refers to that Ni powder is diffused and attached to the A alloy powder or the B alloy powder. If Ni is added only in the form of diffused alloy powder without using it in the form of single powder, the density of Ni is uniformed and no segregation occurs. For this reason, the above-mentioned effects are unobtainable and the compacting property is deteriorated. If the addition amount of Ni is less than 3% by weight with respect to the weight the preliminarily mixed powder, the above-mentioned effects are insufficiently obtained. In contrast, if it is added more than 20% by weight, the amount of the soft austenite phase is increased to deteriorate the wear resistance. For this reason, the addition amount of Ni is limited to the range of from 3 to 20% by weight.

Graphite Powder

When the C alloy powder is applied, in its dissolved state, to the A or B alloy power, the alloy powder is hardened to deteriorate the compacting property. For this reason, it is applied in the form of graphite powder. C, which is applied in the form of graphite powder, strengthens the matrix and improves the wear resistance. If the addition amount of C is less than 0.6% by weight, the ferrite, which deteriorates in both the wear resistance and the strength, remains in the structure of the matrix. In contrast, if it is more than 1.2% by weight, the cementite begins to precipitate at the grain boundary to decrease the strength. For this reason, the graphite to be added is limited to the range of from 0.6 to 1.2% by weight with respect to the weight of the preliminarily mixed powder.

(2) Mixed Powder

C Alloy Powder

In order to diffuse the first hard phase in the matrix consisting of the A alloy powder, the B alloy powder, the Ni powder and the graphite powder to provide superb wear resistance thereto, C alloy powder consisting of Co based alloy is prepared.

Co: Co has the function to bind the first hard phase firmly to the matrix when it is diffused into the matrix. The Co diffused into the matrix serves to strengthen the matrix and improve the heat resistance of the matrix, as well as the matrix of the first hard phase. Part of Co, together with Mo and Si, forms Mo—Co silicide. This silicide serves as a core of the first hard phase to improve the wear resistance. By the foregoing, the C alloy powder is formed from the Co based alloy. The ground for the numerical limitation of the chemical composition of the C alloy powder is described hereinafter.

Mo: Mo contained in the C alloy powder is bound mainly to Si to form a hard Mo silicide, and partly reacted with Co to form Mo—Co silicide. The silicide thus formed serves as a core of the first hard phase to contribute to the improvement of the wear resistance. If the content of Mo contained in the C alloy powder is less than 26% by weight with respect to the weight of the C alloy powder, a sufficient amount of silicide is not obtained. In contrast, if it is more than 30% by weight, the amount of formed silicide is increased to promote the wear of the counterpart component element. For this reason, the content of Mo contained in the C alloy powder is limited to the range of from 26 to 30% by weight.

Si: Si contained in the C alloy powder is bound to Mo and Co to form a hard Mo suicide and Mo—Co silicide, and serves as a core of the first hard phase to contribute to the improvement of the wear resistance. If the content of Si contained in the C alloy power is less than 2% by weight with respect to the weight of the C alloy powder, a sufficient amount of silicide is not precipitated. In contrast, if it is more than 3% by weight, the powder is increasingly hardened to deteriorate the compacting property and the amount of formed silicide is increased to promote the wear of the counterpart component element. For this reason, the content of Si contained in the C alloy powder is limited to the range of from 2 to 3% by weight.

Cr: Cr contained in the C alloy powder is diffused into the matrix of the sintered alloy and serves to strengthen the matrix and to improve the hardening property of the matrix. It also serves to bind the first hard phase firmly to the matrix. Moreover, Cr forms a diffused phase around the first hard phase together with Co thereby absorb the shock applicable when it is struck by the counterpart component element. If the content of Cr contained in the C alloy powder is less than 7% by weight, the abovementioned effects are insufficiently obtained. In contrast, if it is more than 9% by weight, the powder is increasingly hardened to deteriorate the hardness. For this reason, the content of Cr is limited to the range of from 7 to 9% by weight.

Addition Amount of C Alloy Powder

As previously described, the first hard phase consisting of the C alloy powder is attached firmly to the matrix, and its remaining powder portion forms a core of the hard phase having hard particles consisting of Mo suicide as a main component. A dispersed phase (white phase) where the density of Co and Cr is high surrounds this core. If the addition amount of the C alloy powder is less than 5% by weight with respect to the weight of the mixed powder as a whole, the first hard phase is insufficiently formed, thereby unable to contribute to the improvement of the wear resistance. Even if the addition amount of the C alloy powder is more than 25% by weight, no further improvement of the wear resistance can be obtained. In addition, the phase which is hard but lacks the toughness is increased to decrease the material strength, to deteriorate the compacting property, and to promote the wear of a used for compacting operation. For this reason, the amount of addition of the C alloy powder is limited to the range of from 5 to 25% by weight with respect to the weight of the mixed powder as a whole.

D Alloy Powder

As previously described, improvement of the wear resistance is restricted by adding only C alloy powder. The inventors found out that the second hard phase is effective for further improvement of the wear resistance. The ground for the numerical limitation of the chemical composition of the D alloy powder is described hereinafter.

Cr: Cr contained in the D alloy powder forms Cr carbide with C contained in the D alloy powder and serves as a core of the second hard phase thereby to contribute the improvement of the wear resistance. Part of Cr is diffused into the matrix to improve the hardening property of the matrix, and to promote martensite transformation. In a portion around the second hard phase where Cr is high in the density, the part of Cr forms a mixed phase of ferrite and austenite, so that the effects for absorbing a shock when the valve is seated. If the content of Cr contained in the D alloy powder is less than 4% by weight with respect to the weight of the D alloy powder as a whole, the amount of formed carbide is insufficient, thus unable to contribute to the improvement of the wear resistance. In contrast, if it is more than 25% by weight, the amount of formed carbide is increased to promote the wear of the counterpart component element, and the powder is hardened to deteriorate the compacting property. As the amount of the mixed phase of the ferrite and austenite is increased, the wear resistance is also deteriorated. For this reason, the content of Cr contained in the D alloy powder is limited to the range of from 4 to 25% by weight.

C: As previously described, C contained in the D alloy powder forms Cr carbide and serves as a core of the second hard phase to contribute to the improvement of the wear resistance. If the content of C contained in the D alloy powder is less than 0.25% by weight with respect to the weight of the D alloy powder as a whole, the carbide is insufficiently precipitated, thus unable to contribute to the improvement of the wear resistance. In contrast, if it is more than 2.4% by weight, the formed carbide is increased to promote the wear of the counterpart component element and the powder is hardened to deteriorate the compacting property. For this reason, the content of C contained in the D alloy powder is limited to the range of from 0.25 to 2.4% by weight.

Addition Amount of D Alloy Powder

The second hard phase consisting of the D alloy powder forms a structure in which the remaining powder portion forms a core of the hard phase having hard particles consisting of Cr carbide and a soft mixed phase of austenite and ferrite where the density of Cr is high surrounds this core. As previously described, the second hard phase serves to supplement the wear resistance caused by the first hard phase and prevent the deterioration of the material strength owing to the presence of the mixed phase which is rich in the toughness.

If the addition amount of the D alloy powder is less than 5% by weight with respect to the weight of the mixed power as a whole, the amount of formed hard phase is insufficient thus unable to contribute to the improvement of the wear resistance. Even if the addition amount is more than 30% by weight, no further improvement of the wear resistance is obtainable. In addition, a mixed phase of austenite and ferrite which are soft and high in the density of Cr is increased to decrease the material strength and to deteriorate the compacting property. For this reason, the addition amount of the D alloy powder is limited to the range of from 5 to 30% by weight with respect to the weight of the mixed powder as a whole.

The sintered alloy having superb wear resistance which is produced by using a mixed powder consist ing of prescribed amounts of the A–D alloy powders, Ni powder, and graphite powder has a structure consisting, percent by weight of, as a whole, Ni in the amount of 1.35 to 19.61%; Cr in the amount of 0.9 to 11.05%; Mo in the amount of 1.44 to 9.09%; Co in the amount of 3.6 to 20.05%; V in the amount of 0.018 to 0.26%; Si in the amount of 0.1 to 0.75%; C in the amount of 0.35 to 1.5%; and the balance of Fe; and the sintered alloy exhibits a metallographic structure in which the following hard phases are dispersed in a mixed structure of martensite, sorbite, and austenite:

a first hard phase comprising, a hard phase as a core mainly consisting of Mo silicide, and a diffused phase including diffused Co surrounding the hard phase; and a second hard phase comprising, a hard phase as a core consisting of Cr carbide, and a mixed phase of ferrite and austenite surrounding the hard phase.

The second process for producing a sintered alloy having superb wear resistance according to the present invention is characterized by comprising:

preparing the following alloy powders,

A alloy powder consisting, percent by weight, of Cr in the amount of 2 to 4%, Mo in the amount of 0.2 to 0.4%, V in the amount of 0.2 to 0.4%, and the balance of Fe;

B alloy powder consisting, percent by weight, of Ni in the amount of 3% or less, Mo in the amount of 0.5 to 3%, Co in the amount of 5.5 to 7.5%, and the balance of Fe;

C alloy powder consisting, percent by weight, of Mo in the amount of 26 to 30%, Cr in the amount of 7 to 9%, Si in the amount of 2 to 3%, and the balance of Co; and E alloy powder consisting, percent by weight, of Cr in the amount of 4 to 25%, C in the amount of 0.25 to 2.4%, at least one of Mo in the amount of 0.3 to 3%, V in the amount of 0.2 to 2.2%, and W in the amount of 1 to 5%, and the balance of Fe;

adding, percent by weight, a Ni powder in the amount of 3 to 20%, and a graphite powder in the amount of 0.6 to 1.2% to the A alloy powder and the B alloy powder whose mutual weight ratio is 25:75 to 75:25 so as to be turned into a preliminarily mixed powder (the weight ratio is with respect to the preliminarily mixed powder as a whole); and using a mixed powder obtained by adding the C alloy powder in the amount of 5 to 25% by weight, and the E alloy powder in the amount of 5 to 30% by weight to the preliminarily mixed powder (the weight ratio is with respect to the mixed powder as a whole).

The second process for producing an alloy having superb wear resistance is characterized by using the E alloy powder instead of the D alloy powder. The E alloy powder is obtained by adding Mo and V, and further adding W in accordance with necessity, to the D alloy powder, so that Mo carbide, V carbide or W carbide are precipitated as hard particles in the second hard phase in addition to Cr carbide, thereby to further improve the wear resistance. The ground for the numerical limitation of the chemical composition of the E alloy powder is described hereinafter.

E Alloy Powder

Cr: Cr contained in the E alloy powder forms Cr carbide with C contained in the E alloy powder and serves as a core of the second hard phase thereby to contribute the improvement of the wear resistance. Part of Cr is diffused into the matrix to improve the hardening property of the matrix, and to promote martensite transformation. In a portion around the second hard phase where Cr is high in the density, the part of Cr forms a mixed phase of ferrite and austenite, so that the effects for absorbing a shock when it is struck by the counterpart component element. If the content of Cr contained in the E alloy powder is less than 4% by weight with respect to the weight of the E alloy powder as a whole, the amount of formed carbide is insufficient, thus unable to contribute to the improvement of the wear resistance. In contrast, if it is more than 25% by weight, the amount of formed carbide is increased to promote the wear of the counterpart component element, and the powder is hardened to deteriorate the compacting property. As the amount of the mixed phase of the ferrite and austenite is increased, the wear resistance is also deteriorated. For this reason, the content of Cr contained in the E alloy powder is limited to the range of from 4 to 25% by weight.

Mo: Mo contained in the E alloy powder forms Cr and the intermetallic compound with Cr and further forms carbide with C contained in the E alloy powder so as to serve as a core of the second hard phase together with the Cr carbide and to contribute to improve the wear resistance. Mo, which does not form the carbide or the intermetallic compound dissolves in the second hard phase thereby to serve to increase the hardness of the second hard phase at elevated temperatures and to increase the strength at elevated temperatures. If the content of Mo contained in the E alloy powder is less than 0.3% by weight with respect to the weight of the E alloy powder as a whole, the above-mentioned effects are insufficiently obtained. In contrast, if it is more than 3% by weight, the amount of precipitated carbide is increased to promote the wear of the counterpart component element. For this reason, the content of Mo contained in the E alloy is limited to the range from 0.3 to 3% by weight.

V and W: V and W contained in the E alloy powder forms intermetallic compound with Cr contained in the E alloy powder and further forms fine carbide with C contained in the E alloy powder hereby to contribute to the improvement of the wear resistance. The intermetallic compound and the carbide prevent the Cr carbide from becoming more coarse. By this, the wear of the counterpart component element is reduced to improve the wear resistance. If the contents of V and W contained in the E alloy powder is less than 0.2% by weight and less than 1% by weight, respectively, with respect to the weight of the E alloy powder as a whole, the above-mentioned effects are insufficiently obtained. In contrast, if they are more than 2.2% by weight and 5% by weight, respectively, the amount of precipitated carbide is increased to promote the wear of the counterpart component element. For this reason, the content of V contained in the E alloy powder is limited to the range of from 0.2 to 2.2% by weight, and the content of W is limited to the range of from 1 to 5% by weight.

C: As previously described, C contained in the E alloy powder forms carbides with Cr, Mo, V, and W and serves as a core of the second hard phase to contribute to the improvement of the wear resistance. If the content of C contained in the E alloy powder is less than 0.25% by weight with respect to the weight of the E alloy powder as a whole, the carbide is insufficiently precipitated, thus unable to contribute to the improvement of the wear resistance. In contrast, if it is more than 2.4% by weight, the formed carbide is increased to promote the wear of the counterpart component element and the powder is hardened to deteriorate the compacting property. For this reason, the content of C contained in the E alloy powder is limited to the range of from 0.25 to 2.4% by weight.

Addition Amount of E Alloy Powder

The second hard phase consisting of the E alloy powder forms a structure in which the remaining powder portion forms a core of the hard phase having hard particles consisting of Cr carbide as a main component, and a mixed phase of austenite and ferrite, which are soft and high in density of Cr, surrounds the core. If the addition amount of the E alloy powder is less than 5% by weight with respect to the weight of the mixed powder as a whole, the formed hard phase is decreased, thus unable to contribute to the improvement of the wear resistance. Even if it is more than 30% by weight, no further improvement of the wear resistance is obtainable, and in addition, the amount of the mixed phase of austenite and ferrite which are soft and high in the density of Cr is increased to decrease the material strength, and to deteriorate the compacting property of the powder. For this reason, the addition amount of the E alloy powder is limited to the range of from 5 to 30% by weight with respect to the weight of the mixed powder as a whole.

The sintered alloy having superb wear resistance produced by using a mixed powder consisting of the prescribed amounts of the A–C alloy powders, E alloy powder, Ni powder, and graphite powder has a structure consisting, percent by weight of, as a whole Ni in the amount of 1.35 to 19.61%; Cr in the amount of 0.9 to 11.05%; Mo in the amount of 1.44 to 9.42%; Co in the amount of 3.6 to 20.05%; V in the amount of 0.018 to 0.85%; Win the amount of 0 to 1.50%; Si in the amount of 0.1 to 0.75%; C in the amount of 0.35 to 1.5%; and the balance of Fe; and the sintered alloy exhibits a metallographic structure in which the following hard phases are dispersed in a mixed structure of martensite, sorbite, and austenite:

- a first hard phase comprising, a hard phase as a core mainly consisting of Mo silicide, and a diffused phase including diffused Co surrounding the hard phase; and
- a second hard phase comprising, a hard phase as a core mainly consisting of Cr carbide as a main component, and a mixed phase of ferrite and austenite surrounding the hard phase.

Powders of Lead, Manganese Sulfide, Boron Nitride, and Meta-magnesium Silicate

In order to improve the machinability of the sintered alloy having superb wear resistance according to the present invention, at least one of a lead powder, a manganese sulfide powder, a boron nitride powder, and a meta-magnesium silicate metal powder in the amount of 0.3 to 2.0% by weight can be added to the mixed powder. The ground for the numerical limitation of this addition amount is as described previously.

Containing of Lead, Acrylic Resin, Cu or Cu Alloy

Lead, acrylic resin, or copper or copper alloy may be infiltrated or impregnated into pores formed in a sintered alloy having superb wear resistance according to the present invention. Specifically, those metals can be infiltrated or impregnated into the pores by adding the powders of lead, and copper or copper alloy to the mixed powder and then sintering a compact of powders. In the alternative, acrylic resin can be filled (impregnated) in the pores by filling a melted acrylic resin and the sintered alloy haveing superb wear resistance into a hermetically closed container and then reducing the pressure in the container. It is also accepted that those metals are infiltrated into the pores by using a melted lead, or Cu or Cu alloy instead of the acrylic resin.

Subzero Treatment

A sintered alloy having superb wear resistance according to the present invention is subjected to subzero treatreatment processing so that the austenite phase is partly turned into martensite having a large physical strength. By doing so, the strength and the wear resistance can be further improved. It should be noted, however, that when the acrylic resin is impregnated, the subzero treatment must be applied before the resin is impregnated, in order to prevent the impregnated resin from being deteriorated by the subzero treatment.

DETAILED DESCRIPTION OF THE EMBODIMENT(S)

Figure 1:
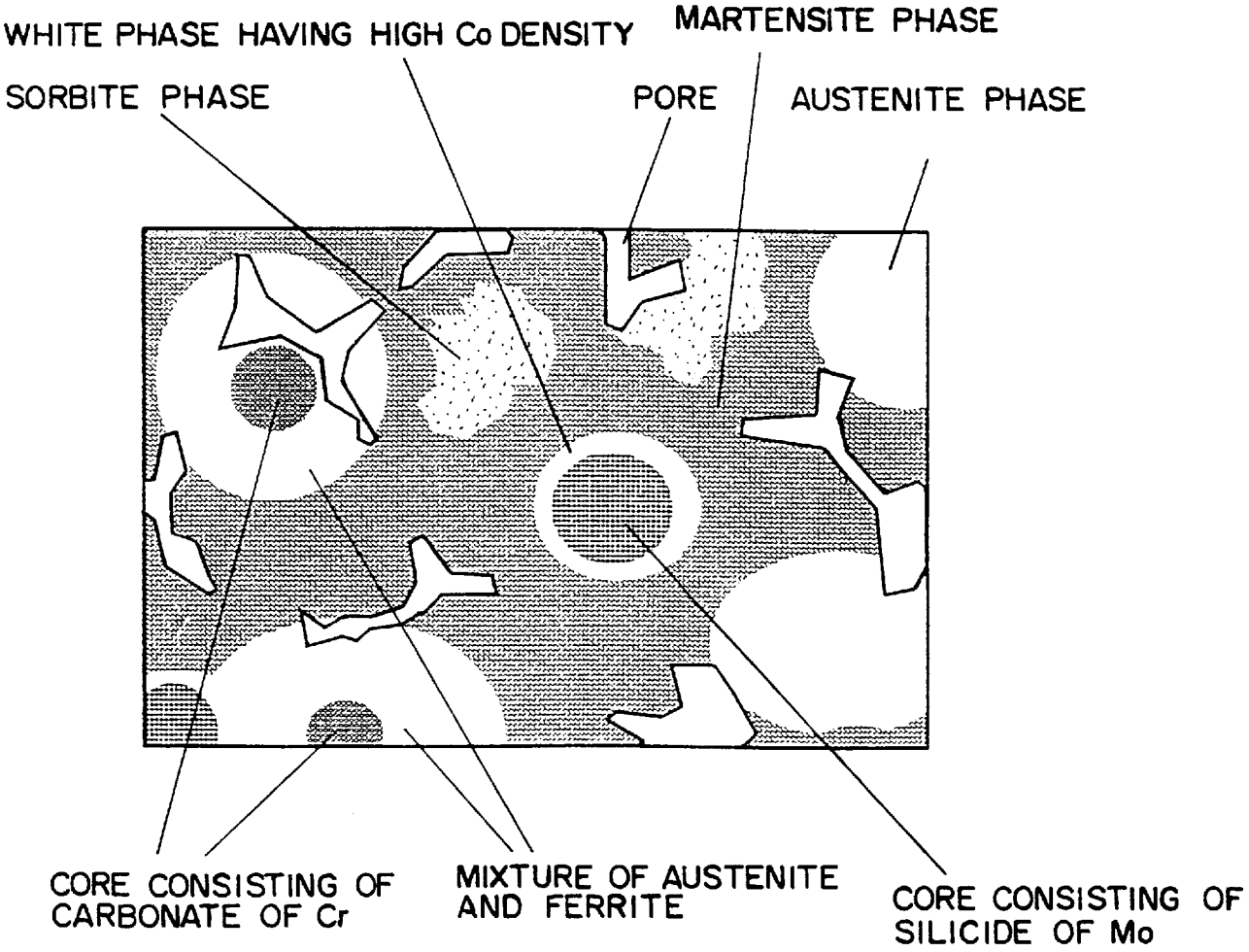
FIG. 1 is a view schematically showing the metallographic structure of a sintered alloy having superb wear resistance according to the present invention.

The embodiment(s) of the present invention will now be described hereinafter.

Evaluation Test 1

A alloy powder of Fe-3Cr-0.3Mo-0.3V, B alloy powder of Fe6.5Co-1.5Mo, Ni powder, and graphite powder were mixed together at the mixing ratio shown in Table 1 to obtain twenty (20) kinds, in total, of preliminarily mixed powders including preliminarily mixed powders (Y1 to Y10) of the present invention having powder compositions shown in Table 1, and comparative preliminarily mixed powders (Y11 to Y20) which are partly departed from the scope of the present invention. Also, C alloy powder of Co-28Mo-8Cr-2.5Si, eight(8) kinds, in total, of D alloy powders including D alloy powders (D1 to D6) of the present invention having the powder components shown in Table 2, and comparative D alloy powders (D7 and D8) whose compositions are partly departed from the scope of the present invention, and seven (7) kinds of E alloy powders (E1 to E7) of the present invention were prepared.

After preparing the preliminarily mixed powders, the C alloy powers, the D alloy powders, or the E alloy powders were mixed together at the mixing ratio shown in Table 3, they were compacted under the pressure of 6.5 ton/cm$^2$ and sintered for sixty (60) minutes at a temperature of 1180° C. in a dissociated ammonia gas. As a result, alloys of the present invention (Sample No. 1 to 31) and comparative alloys (Sample No. 32 to 50) whose constituent compositions are partly departed from the scope of the present invention were obtained. The comparative alloy of Sample No. 49 is the conventional alloy disclosed in the aforementioned Japanese Patent Examined Publication (KOKOKU) No. 55593/93, and the comparative alloy of Sample No. 50 is the alloy disclosed in the Japanese Patent Examined Publication (KOKOKU) No. 98985/95.

TABLE 1

| PMP | Mixing Ratio wt. % | | | | | Powder Composition wt. % | | | | | | | |
|---|---|---|---|---|---|---|---|---|---|---|---|---|---|
| No. | A Alloy Powder | B Alloy Powder | Ni Powder | Graphite Powder | A:B | Fe | Ni | Cr | Co | Mo | V | C | |
| Y1 | 66.90 | 22.30 | 10.00 | 0.80 | 75:25 | Balance | 10.00 | 2.01 | 1.45 | 0.54 | 0.20 | 0.80 | |
| Y2 | 44.60 | 44.60 | 3.00 | 0.80 | 50:50 | Balance | 3.00 | 1.34 | 2.90 | 0.80 | 0.13 | 0.80 | |
| Y3 | 44.60 | 44.60 | 6.00 | 0.80 | 50:50 | Balance | 6.00 | 1.34 | 2.90 | 0.80 | 0. 13 | 0.80 | |
| Y4 | 44.60 | 44.60 | 10.00 | 0.60 | 50:50 | Balance | 10.00 | 1.34 | 2.90 | 0.80 | 0.13 | 0.60 | |
| YS | 44.60 | 44.60 | 10.00 | 0.80 | 50:50 | Balance | 10.00 | 1.34 | 2.90 | 0.80 | 0.13 | 0.80 | |
| Y6 | 44.60 | 44.60 | 10.00 | 1.00 | 50:50 | Balance | 10.00 | 1.34 | 2.90 | 0.80 | 0.13 | 1.00 | |
| Y7 | 44.60 | 44.60 | 10.00 | 1.20 | 50:50 | Balance | 10.00 | 1.34 | 2.90 | 0.80 | 0.13 | 1.20 | |
| Y8 | 44.60 | 44.60 | 15.00 | 0.80 | 50:50 | Balance | 15.00 | 1.34 | 2.90 | 0.80 | 0.13 | 0 80 | |
| Y9 | 44.60 | 44.60 | 20.00 | 0.80 | 50:50 | Balance | 20.00 | 1.34 | 2.90 | 0.80 | 0.13 | 0 80 | |
| Y10 | 22.30 | 66.90 | 10.00 | 0.80 | 25:75 | Balance | 10.00 | 0.67 | 4.35 | 1.07 | 0.07 | 0.80 | |
| Y11 | 89.20 | | 10.00 | 0.80 | 100:0 | Balance | 10.00 | 2.68 | | 0.27 | 0.27 | 0.80 | N |
| Y12 | 71.36 | 17.84 | 10.00 | 0.80 | 80:20 | Balance | 10.00 | 2.14 | 1.16 | 0.48 | 0.21 | 0.80 | N |
| Y13 | 17.84 | 71.36 | 10.00 | 0.80 | 20:80 | Balance | 10.00 | 0.54 | 4.64 | 1.12 | 0.05 | 0.80 | N |
| Y14 | | 89.20 | 10.00 | 0.80 | 0:100 | Balance | 10.00 | | 5.80 | 1.34 | | 0.80 | N |
| Y15 | 44.60 | 44.60 | | 0.80 | 50:50 | Balance | | 1.34 | 2.90 | 0.80 | 0.13 | 0.80 | N |
| Y16 | 44.60 | 44.60 | 0.75 | 0.80 | 50:50 | Balance | 0.75 | 1.34 | 2.90 | 0.80 | 0.13 | 0.80 | N |
| Y17 | 44.60 | 44.60 | 22.00 | 0.80 | 50:50 | Balance | 22.00 | 1.34 | 2.90 | 0.80 | 0.13 | 0.80 | N |
| Y18 | 44.60 | 44.60 | 10.00 | 0.40 | 50:50 | Balance | 10.00 | 1.34 | 2.90 | 0.80 | 0.13 | 0.40 | N |
| Y19 | 44.60 | 44.60 | 10.00 | 1.40 | 50:50 | Balance | 10.00 | 1.34 | 2.90 | 0.80 | 0.13 | 1.40 | N |
| Y20 | | 89.20 | | 0.80 | 0:100 | Balance | | | 5.80 | 1.34 | | 0.80 | N |

(Note)
"PMP No." means "preliminarily mixed powder number"
""N" means "not within the scope of the claim of the present invention"
A Alloy Powder: Fe-3Cr-0.3Mo-0.3 V
B Alloy Powder: Fe-6.5Co-1.5Mo

TABLE 2

| Powder | Powder Composition wt. % | | | | | | |
|---|---|---|---|---|---|---|---|
| No. | Fe | Cr | Mo | V | W | C | |
| D Alloy Powder | | | | | | | |
| D1 | B1 | 4.00 | | | | 1.40 | |
| D2 | B1 | 8.00 | | | | 1.40 | |
| D3 | B1 | 12.00 | | | | 1.40 | |
| D4 | B1 | 15.00 | | | | 1.40 | |
| D5 | B1 | 20.00 | | | | 1.40 | |
| D6 | B1 | 25.00 | | | | 1.40 | |
| D7 | B1 | 2.00 | | | | 1.40 | N |
| D8 | B1 | 27.00 | | | | 1.40 | N |
| E Alloy Powder | | | | | | | |
| E1 | B1 | 12.00 | 1.00 | | | 1.40 | |
| E2 | B1 | 12.00 | | 0.50 | | 1.40 | |
| E3 | B1 | 12.00 | | | 2.00 | 1.40 | |
| E4 | B1 | 12.00 | 1.00 | 0.50 | | 1.40 | |
| E5 | B1 | 12.00 | 1.00 | | 2.00 | 1.40 | |
| E6 | B1 | 12.00 | | 0.50 | 2.00 | 1.40 | |
| E7 | B1 | 12.00 | 1.00 | 0.50 | 2.00 | 1.40 | |

(Note)
"B1" means "Balance"
"N" means "not within the scope of the claim of the present invention"

TABLE 3

| | Mixing Ratio wt. % | | | | | |
|---|---|---|---|---|---|---|
| | Preliminarily Mixed Powder | | C Alloy Powder | D E Alloy Powders | | |
| Sample No. | Powder No. | Addition Amount | Addition Amount | Powder No. | Addition Amount | |
| 1 | Y1 | Balance | 15.00 | D3 | 15.00 | |
| 2 | Y2 | Balance | 15.00 | D3 | 15.00 | |
| 3 | Y3 | Balance | 15.00 | D3 | 15.00 | |
| 4 | Y4 | Balance | 15.00 | D3 | 15.00 | |
| 5 | Y5 | Balance | 5.00 | D3 | 15.00 | |
| 6 | Y5 | Balance | 10.00 | D3 | 15.00 | |
| 7 | Y5 | Balance | 15.00 | D1 | 15.00 | |
| 8 | Y5 | Balance | 15.00 | D2 | 15.00 | |
| 9 | Y5 | Balance | 15.00 | D3 | 5.00 | |
| 10 | Y5 | Balance | 15.00 | D3 | 10.00 | |
| 11 | Y5 | Balance | 15.00 | D3 | 15.00 | |
| 12 | Y5 | Balance | 15.00 | D3 | 20.00 | |
| 13 | Y5 | Balance | 15.00 | D3 | 25.00 | |
| 14 | Y5 | Balance | 15.00 | D3 | 30.00 | |
| 15 | Y5 | Balance | 15.00 | E1 | 15.00 | |
| 16 | Y5 | Balance | 15.00 | E2 | 15.00 | |
| 17 | Y5 | Balance | 15.00 | E3 | 15.00 | |
| 18 | Y5 | Balance | 15.00 | E4 | 15.00 | |
| 19 | Y5 | Balance | 15.00 | E5 | 15.00 | |
| 20 | Y5 | Balance | 15.00 | E6 | 15.00 | |
| 21 | Y5 | Balance | 15.00 | E7 | 15.00 | |
| 22 | Y5 | Balance | 15.00 | D4 | 15.00 | |
| 23 | Y5 | Balance | 15.00 | D5 | 15.00 | |
| 24 | Y5 | Balance | 15.00 | D6 | 15.00 | |
| 25 | Y5 | Balance | 20.00 | D3 | 15.00 | |
| 26 | Y5 | Balance | 25.00 | D3 | 15.00 | |
| 27 | Y6 | Balance | 15.00 | D3 | 15.00 | |
| 28 | Y7 | Balance | 15.00 | D3 | 15.00 | |
| 29 | Y8 | Balance | 15.00 | D3 | 15.00 | |
| 30 | Y9 | Balance | 15.00 | D3 | 15.00 | |
| 31 | Y10 | Balance | 15.00 | D3 | 15.00 | |
| 32 | Y11 | 70.00 | 15.00 | D3 | 15.00 | N |
| 33 | Y12 | 70.00 | 15.00 | D3 | 15.00 | N |
| 34 | Y13 | 70.00 | 15.00 | D3 | 15.00 | N |
| 35 | Y14 | 70.00 | 15.00 | D3 | 15.00 | N |
| 36 | Y15 | 70.00 | 15.00 | D3 | 15.00 | N |
| 37 | Y16 | 70.00 | 15.00 | D3 | 15.00 | N |
| 38 | Y17 | 70.00 | 15.00 | D3 | 15.00 | N |
| 39 | Y18 | 70.00 | 15.00 | D3 | 15.00 | N |
| 40 | Y19 | 70.00 | 15.00 | D3 | 15.00 | N |
| 41 | Y5 | 85.00 | 0.00 | D3 | 15.00 | N |
| 42 | Y5 | 82.00 | 3.00 | D3 | 15.00 | N |
| 43 | Y5 | 55.00 | 30.00 | D3 | 15.00 | N |
| 44 | Y5 | 70.00 | 15.00 | D7 | 15.00 | N |
| 45 | Y5 | 70.00 | 15.00 | D8 | 15.00 | N |
| 46 | Y5 | 85.00 | 15.00 | D3 | 0.00 | N |
| 47 | Y5 | 82.00 | 15.00 | D3 | 3.00 | N |
| 48 | Y5 | 50.00 | 15.00 | D3 | 35.00 | N |
| 49 | Y20 | 75.00 | 15.00 | | | P1 |
| 50 | Y11 | 75.00 | 15.00 | | | P2 |

(Note)
"N" means "not within the scope of the claim of the present invention"
"P1" means "Alloy of Japanese Patent Examined Publication Number 55593/93"
"P2" means "Alloy of Japanese Patent Examined Publication Number 98985/95"

The measurements of the radial crushing strength and simplified wear tests were carried out for those alloys. The results are shown in Table 5 and in FIGS. 2 through 8. The simplified wear test is a test of the type that a sintered alloy machined into the valve seat configuration is press-fitted in an aluminum alloy housing, and the valve is caused to make an up-and-down motion like a piston by an eccentric cam rotated by a motor, such that the face of the valve and the face of the valve seat are repeatedly hit each other. The temperature setting in this test was carried out by heating the bevel of the valve with a burner in order to simply create an environment resembling the inside of the housing of the engine. In this test, it was set such that the rotating speed of the eccentric cam was 2700 rpm, the test temperature was 250° C. at the valve seat portion, and the repeat time was fifteen (15) hours. The amounts of wear of the valve seat and the valve after the test were measured and evaluated.

As shown in Table 1, the preliminarily mixed powder No. Y1, Y5, Y10, and Y11 to 14 are mutually different in the weight percent of the powders of the A alloy power and the B alloy powder. By comparing the test results of the sintered alloys of the sample No. 1, 11 and 31 to 35 shown in Table 3 using the preliminarily mixed powders Y1, Y5, Y10 and Y11 to Y14, it is checked how the differences of the weight percents between the A alloy powder and the B alloy powder affect. The test results are shown in FIG. 2 together with the total amounts of wear of the conventional sintered alloys of the sample No. 49 and 50.

Figure 2A:
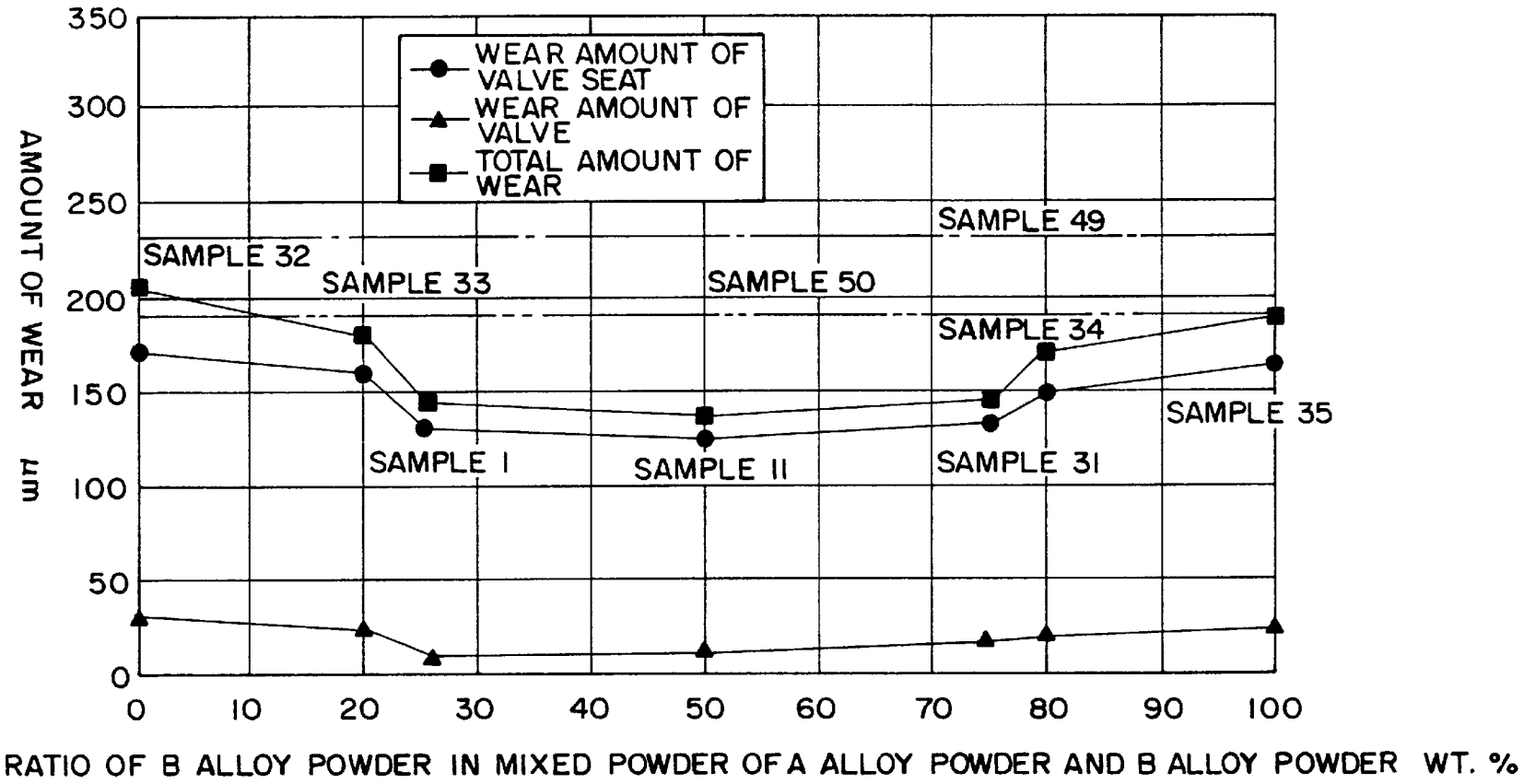
FIG. 2 is a chart showing how the change of the ratio of A alloy power and B alloy powder in the preliminarily mixed powder affects the characteristics, in the embodiment of the present invention.
Figure 2B:
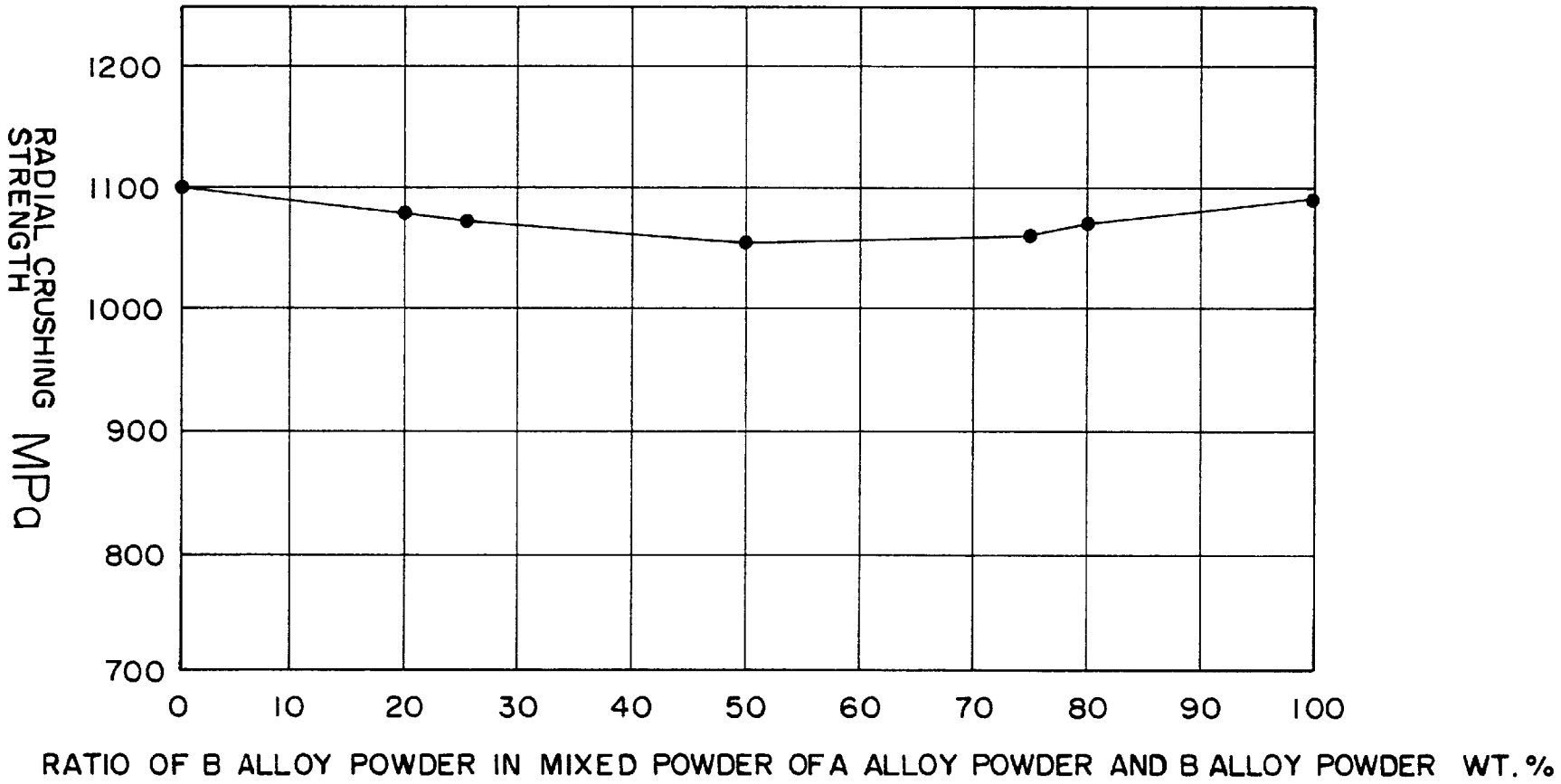

As shown in FIG. 2(*a*), in the sintered alloys (sample No. 1, 11 and 31) whose weight percent of the A alloy powers and the B alloy powders are in the range of from 25:75 to 75:25, it is clear that the wear amounts of the valve seats and the wear amounts of the valves are stable and low, and that favorable wear resistance is exhibited. On the other hand, in the sintered alloys (sample No. 32 to 35, 49 and 50) whose weight percents are departed from the range of from 25:75 to 75:25, it is also clear that the wear amounts of both the valve seats and the valves are large. Also, as shown in FIG. 2(*b*), the radial crushing strengths are generally the same over the entire range where the percentages of the A alloy power and the B alloy powder are 0:100 to 100:10. In this way, it was confirmed that the wear resistance can be improved without decreasing the strength, inasmuch as the weight percents of the A alloy and the B alloy are in the range of from 25:75 to 75:25.

Next, the preliminarily mixed powder No. Y2, Y3, Y5, Y8, Y9, and Y15 to 17 of Table 1 are mutually different in the addition amount of the powders of the Ni powder to be added to the preliminarily mixed powders. By comparing the test results of the sintered alloys of the sample No. 2, 3, 11, 29, 30, and 36 to 38 shown in Table 3 using the preliminarily mixed powders Y2, Y3, Y5, Y8, Y9, and Y15 to Y17, it is checked how the differences of the addition amounts of the Ni powders to be added to the preliminarily mixed powders affect. The test results are shown in FIG. 3 together with the total amounts of wear of the conventional sintered alloys of the sample No. 49 and 50.

Figure 3A:
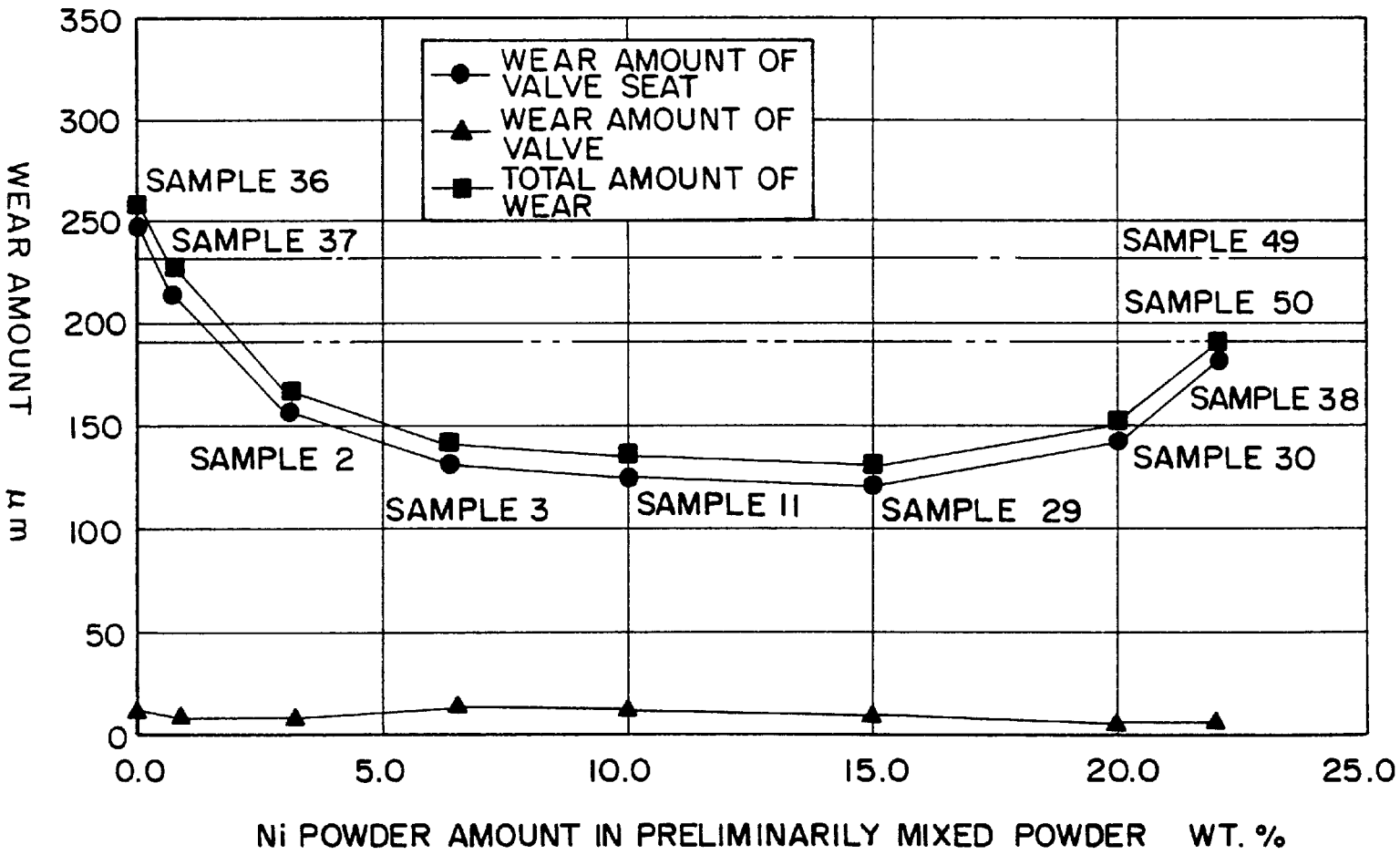
FIG. 3 is a chart showing how the change of the amount of addition of Ni powder in the preliminarily mixed powder affects the characteristics, in the embodiment of the present invention.
Figure 3B:
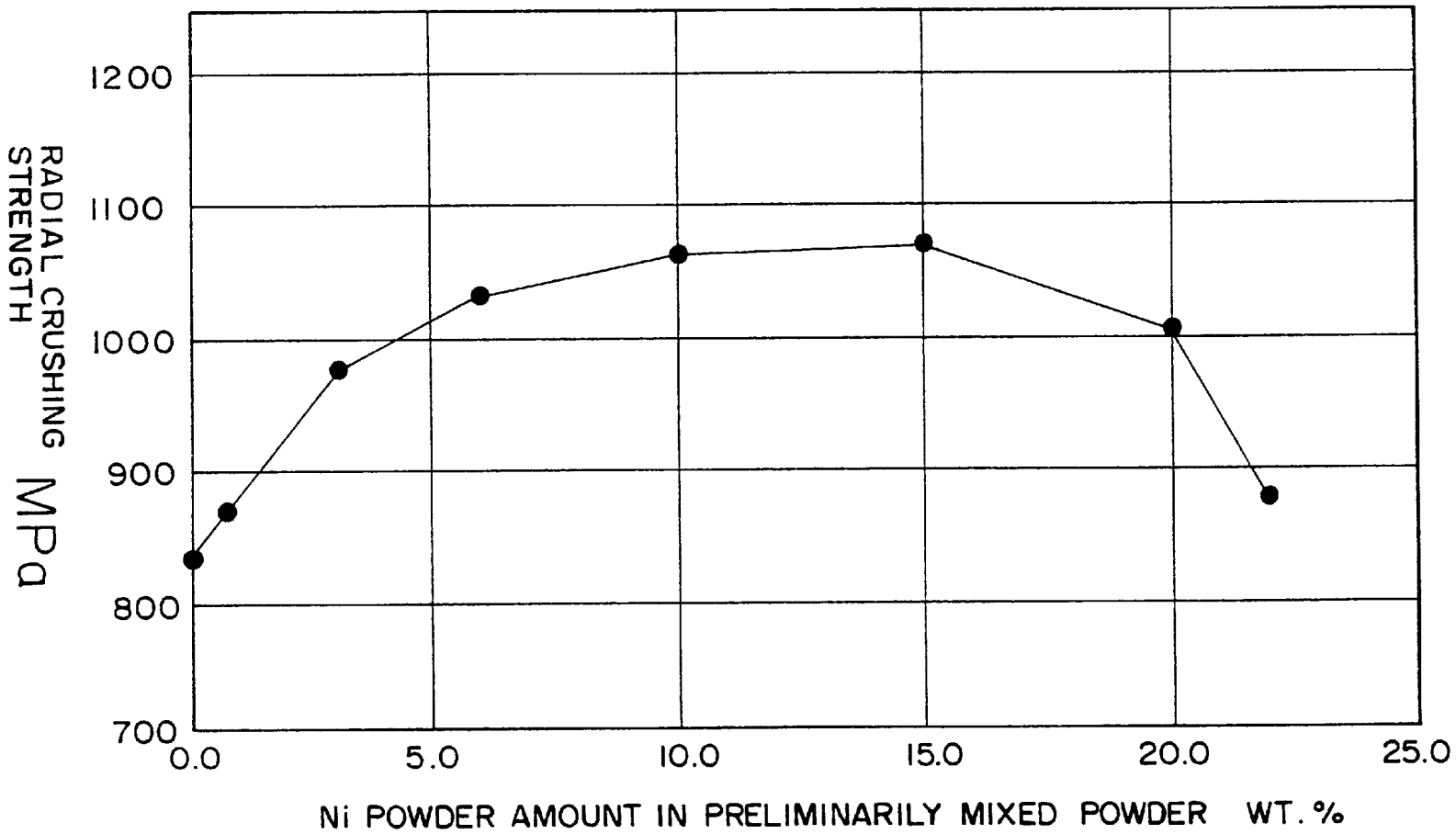

As shown in FIG. 3(*a*), in the sintered alloys (sample No. 2, 3, 11, 29, and 30) whose addition amounts of Ni powder in the preliminarily mixed powder are in the range of from 3 to 20% by weight, it is clear that the wear amounts of the valve seats and the wear amounts of the valves are stable and low, and that favorable wear resistance is exhibited. Also, as shown in FIG. 3(*b*), it is know that the radial crushing strength is high in the sintered alloy within the scope of the present invention. On the other hand, in the sintered alloys (sample No. 36 to 38, 49 and 50) whose addition amounts of Ni powders are departed from the range of from 3 to 20% by weight, it is also clear that the wear amounts of both the valve seats and the valves are large and the radial crushing strength is low. In this way, it was confirmed that when the addition amounts of the Ni powders are more than 20% by weight, the strength and the wear resistance are rather decreased because the soft austenite phase is overly increased.

Next, the preliminarily mixed powders Y4 to Y7, Y18, and Y19 of Table 1 are mutually different in the addition amount of the graphite powders to be added to the preliminarily mixed powders. By comparing the test results of the sintered alloys of the sample No. 4, 11, 27, 28, 39, and 40 of Table 3 using the preliminarily mixed powders Y4 to Y7, Y18, and Y19, it is checked how the difference in the addition amounts of the graphite powders to be added to the preliminarily mixed powers affect. The test results are shown in FIG. 4 together with the total amounts of wear of the conventional sintered alloys of the sample No. 49, and 50.

Figure 4A:
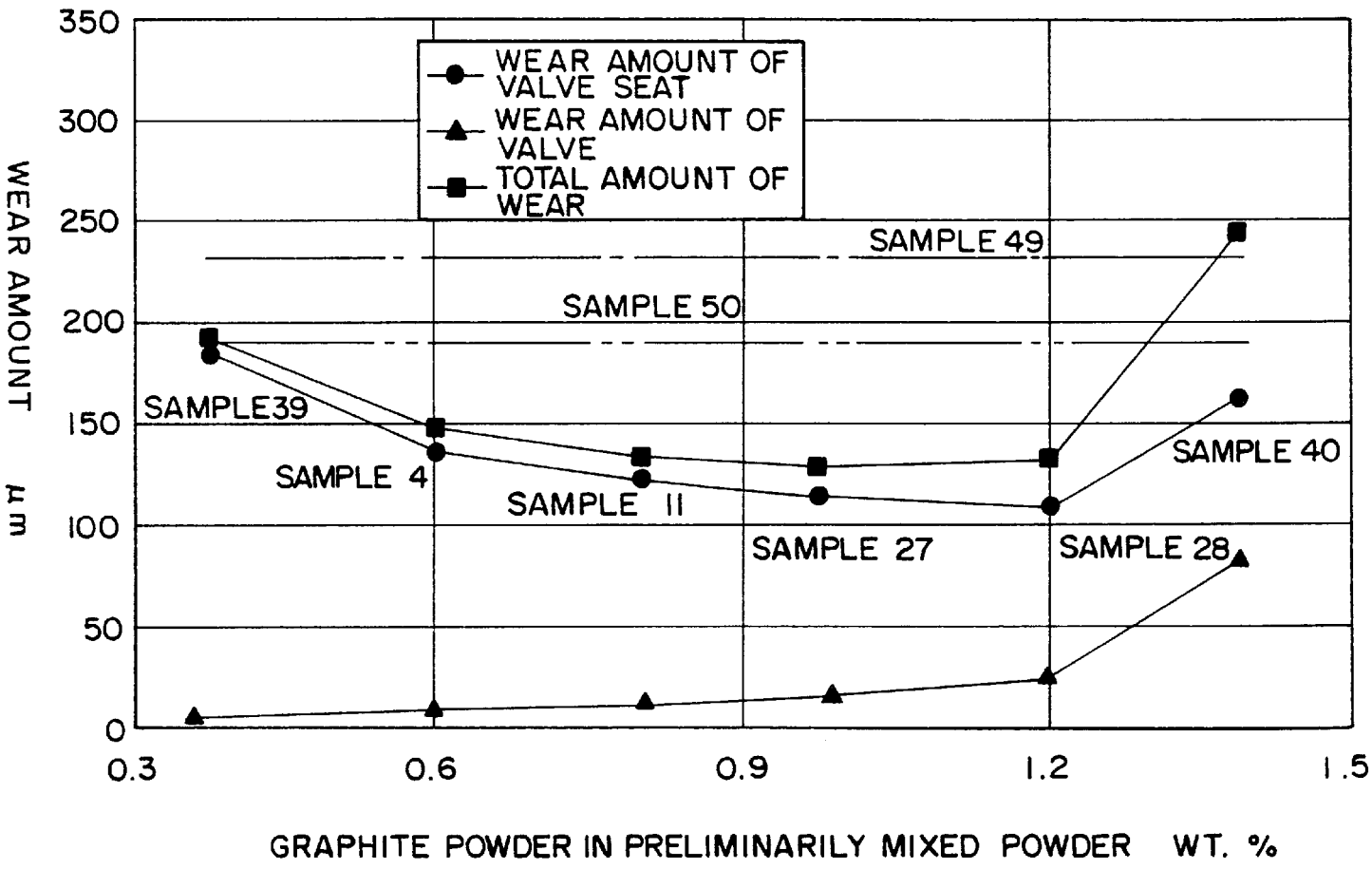
FIG. 4 is a chart showing how the change of the amount of addition of graphite powder in the preliminarily mixed power affects the characteristics, in the embodiment of the present invention.
Figure 4B:
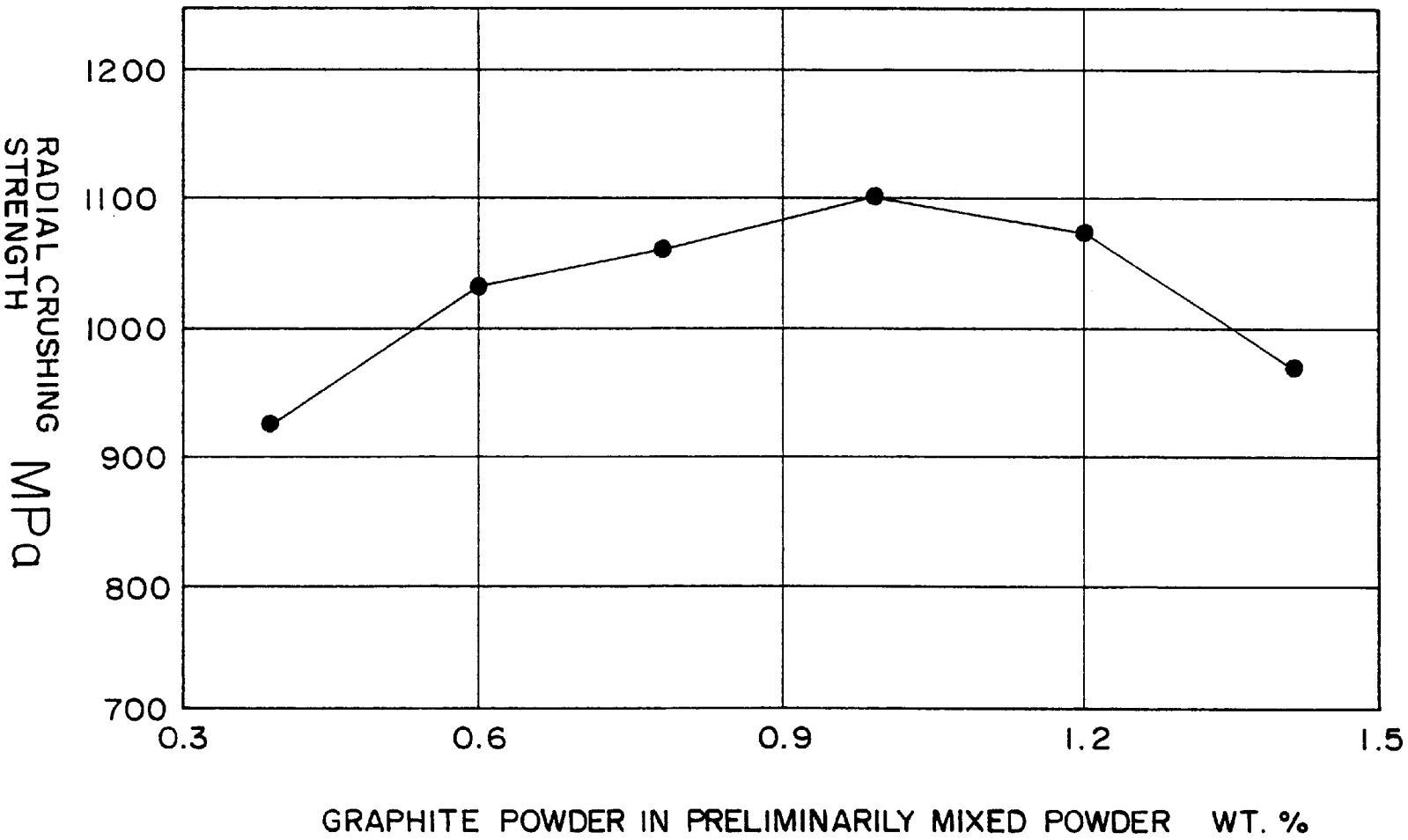

As apparent from FIG. 4(*a*), with the increase of the addition amounts of the graphite powers contained in the preliminarily mixed powders, the matrix is strengthened, and the wear amount of the valve seat tends to lower until the time when the addition amount reaches 1.2% by weight. On the contrary, the wear amount of the valve tends to increase gradually. However, it is known that when the addition amounts of the graphite exceeds 1.2% by weight, the valve attackability is increased and the wear amounts of the valve are also abruptly increased because the cementite is precipitated to cause the matrix to be rather brittle so that the wear resistance is deteriorated. In this way, the total wear amounts of the valves and the valve sheets show stable and low values when the addition amounts of the graphite powders are in the range of from 0.6 to 12.% by weight. Also, as shown in FIG. 4(*b*), as the addition amounts of the graphite powders are increased, the matrix is strengthened and the radial crushing strength is increased, but when the addition amounts of the graphite powders exceed 1.2% by weight, the radial crushing strength is rather lowered because of brittleness of the matrix due to precipitation of the cementite. In this way, it was confirmed that when the addition amounts of the graphite powders into the preliminarily mixed powders are in the range of from 0.6 to 1.2% by weight, both the wear resistance and the strength are favorable.

Next, the sample No. 5, 6, 11, 25, 26, and 41 to 43 of Table 3 are mutually different in the addition amounts of the C alloy powders to the mixed powers. By comparing the test results of the sintered alloys, it is checked how the difference in the addition amounts of the C alloy powders to be added to the mixed powders affect. The test results are shown in FIG. 5 together with the total amounts of wear of the conventional sintered alloys of the sample No. 49 and 50.

Figure 5A:
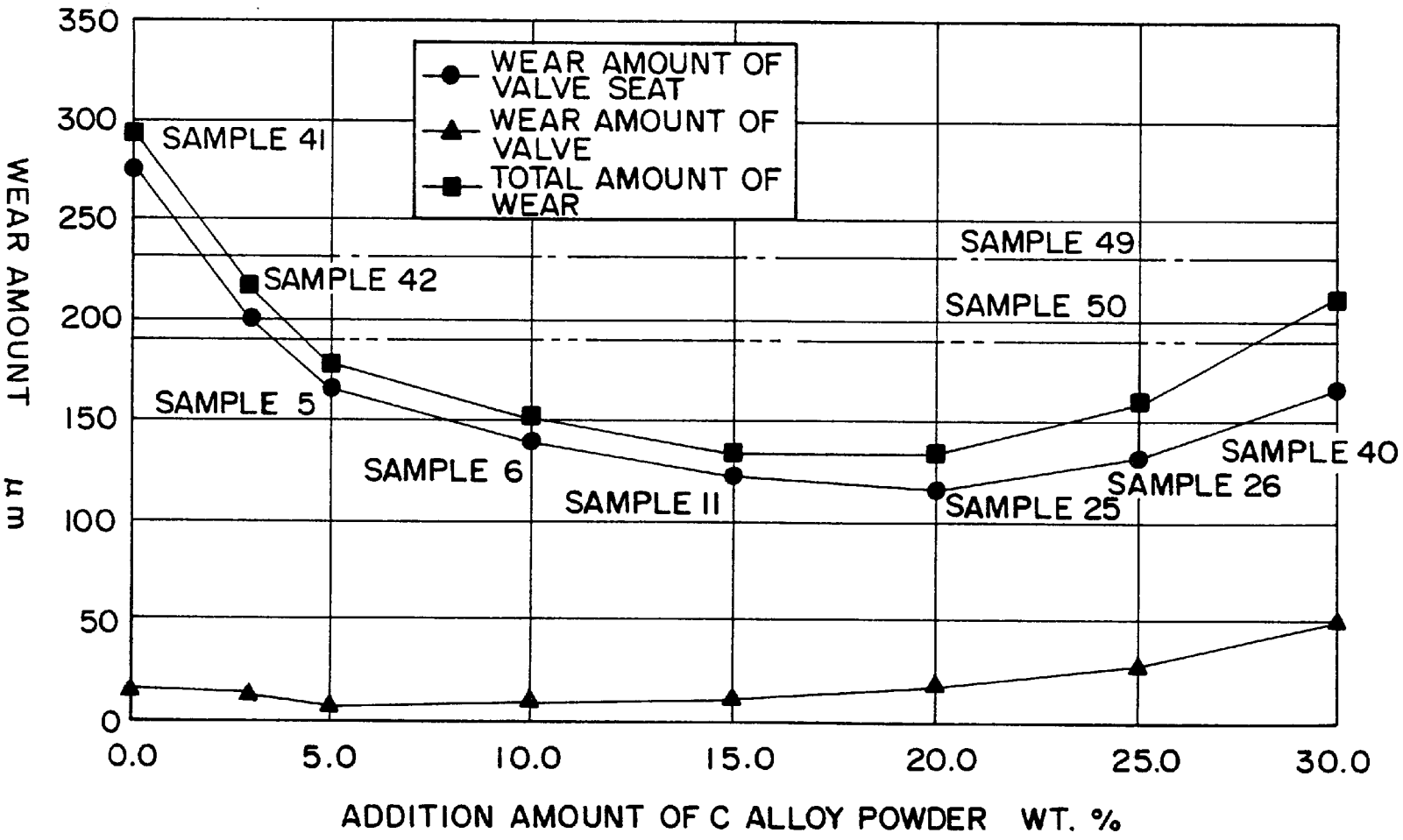
FIG. 5 is a chart showing how the change of the amount of addition of C alloy powder affects the characteristics, in the embodiment of the present invention.
Figure 5B:
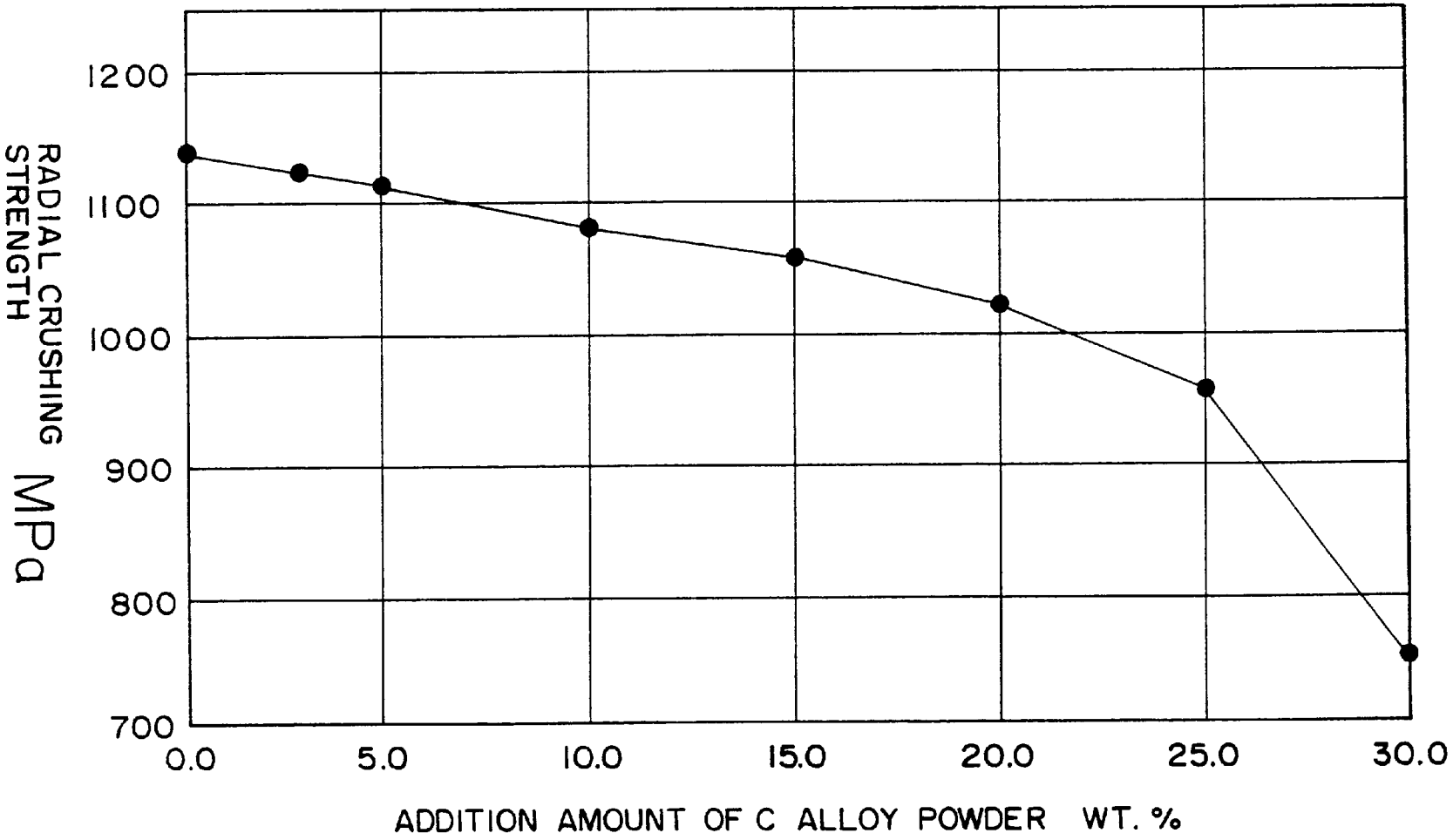

As shown in FIG. 5(*a*), with the addition of the C alloy powders, the wear amounts of the valve seats are lowered, and when the addition amounts of the C alloy powders are in the range of from 5.0 to 25% by weight, the valves sheets exhibit favorable wear resistance. However, when the addition amounts exceed 25.0% by weight, the compacting property is lowered, and therefore, the green density is lowered and the strength of the sintered bodies is lowered, too. As a consequence, the wear resistance is lowered to exhibit radical wear. The wear amounts of the valves a re gradually increased from about the spot where the addition amounts of the C alloy powders exceed 15% by weight due to increase of the valve attackability. When the addition amounts of the C alloy powders exceed 25.0% by weight, the strength of the matrix is lowered due to deterioration of the compacting property of the powders. At the same time, the wear of the valve seats is also progressed because the worn particles of the valves act as abrasive grains. Therefore, it is known that when the addition amounts of the C alloy powders are in the range of from 5.0 to 25.0% by weight, a favorable wear resistance is exhibited. As shown in FIG. 5(*b*), when the addition amounts of the C alloy powders exceed 25.0% by weight, the radial crushing strength is abruptly lowered. From this, it is known that the green density is lowered and the strength is lowered.

Next, the D alloy powders D1 to D8 of Table 2 are mutually different in the amounts of Cr contained in the D alloy powders. By comparing the test results of the sintered alloys of the sample No. 7, 8, 11, 22 to 24, 44, and 45 of Table 3 using the D alloy powders D1 to D8, it is checked how the difference in the contents of Cr in the D alloy powders affect. The test results are shown in FIG. 6 together with the total wear amounts of the conventional sintered alloys of the sample No. 49, and 50.

Figure 6A:
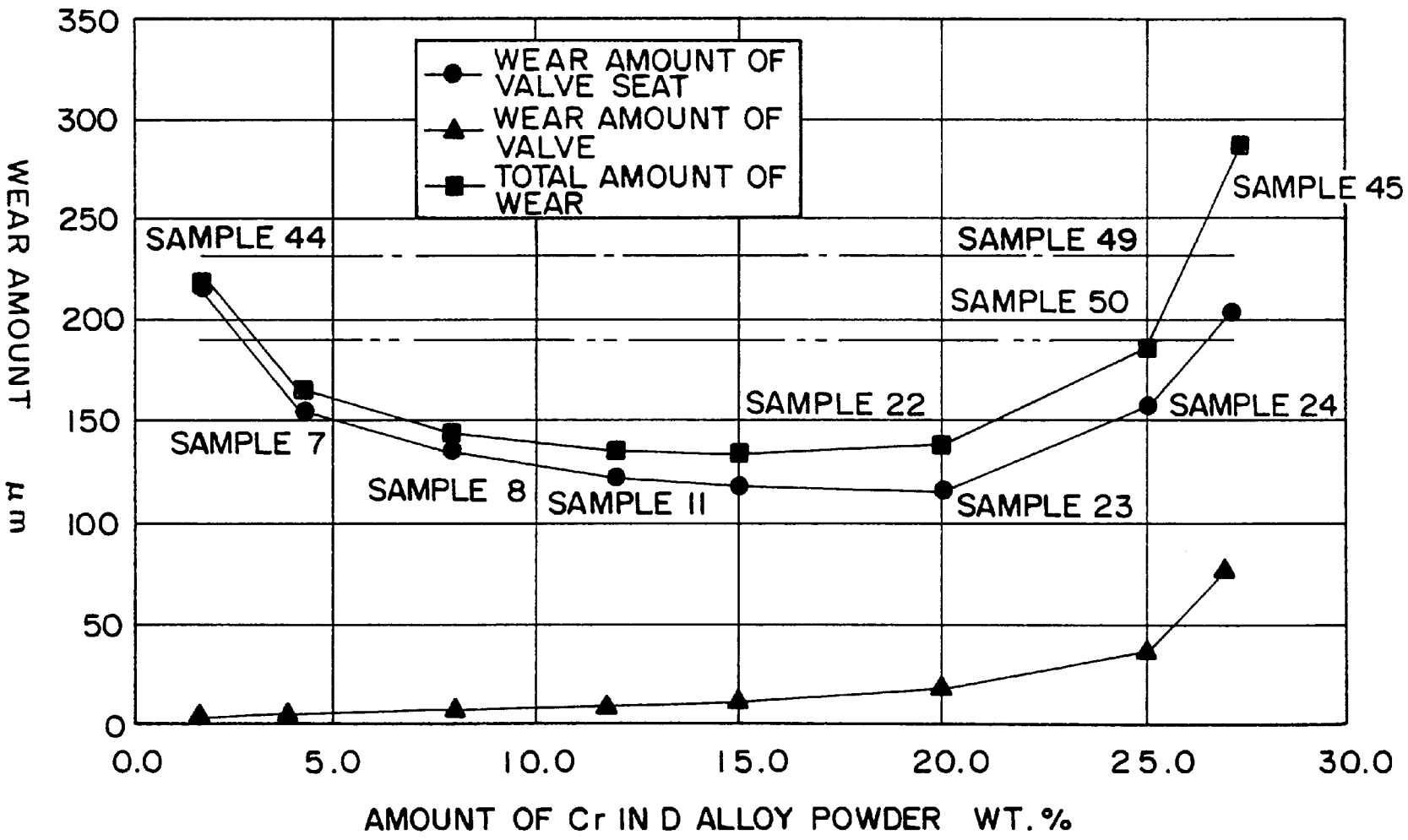
FIG. 6 is a chart showing how the change of the content of Cr in D alloy powder affects the characteristics, in the embodiment of the present invention.
Figure 6B:
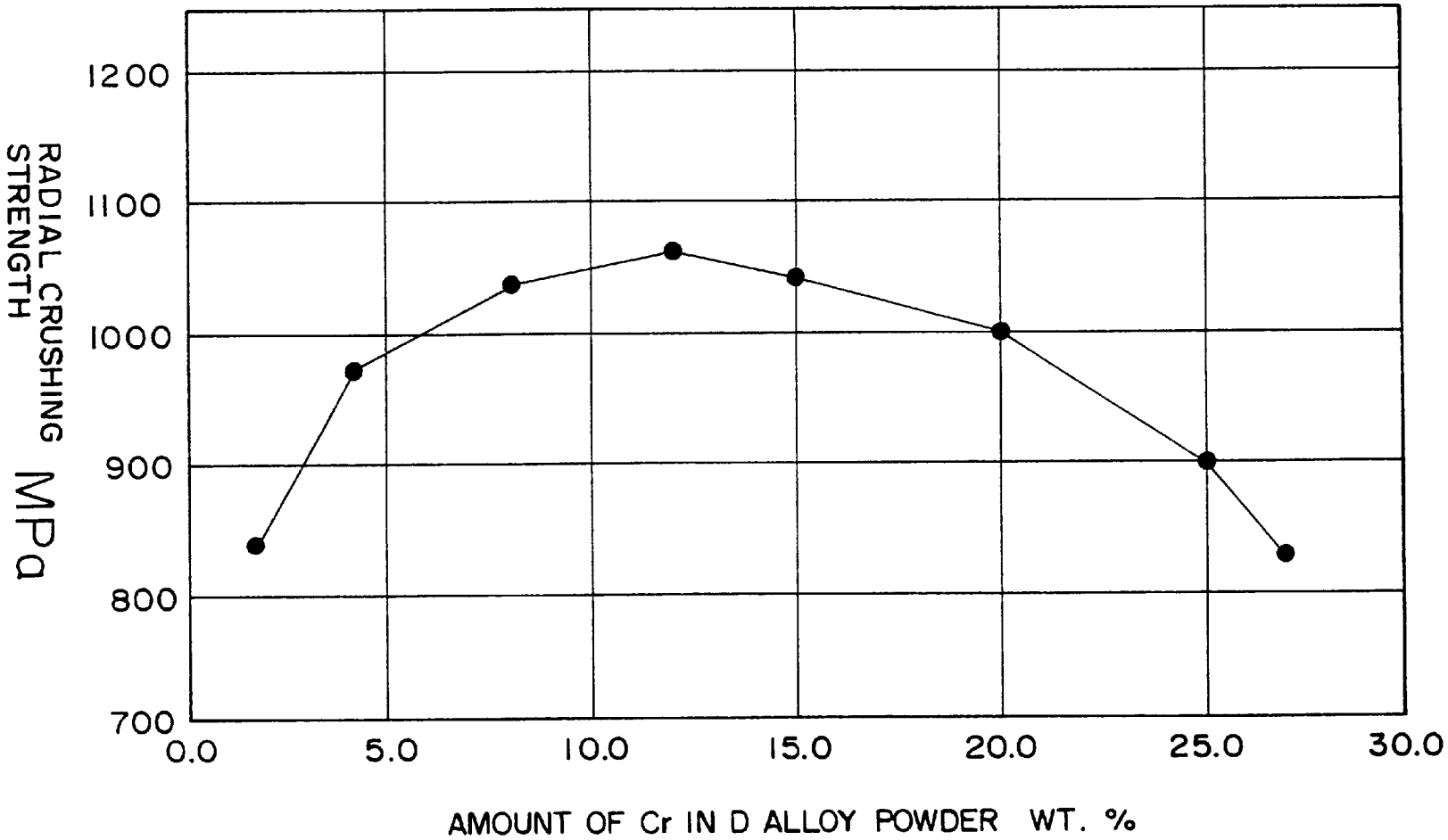

As shown in FIG. 6(*a*), when the contents of Cr in the D alloy powders are in the range of from 4.0 to 25.0% by weight, the wear amounts of the valve seats are so low as 160 micrometers or less. By making the contents of Cr contained in the D alloy powders in the range of from 4.0 to 25.0% by weight (sample No. 7, 8, 11, 22, 23, and 24), it was confirmed that the wear resistance becomes more favorable than the comparative alloy of the sample No. 50 (alloy of Japanese Patent Examined Publication (KOKOKU) No. 98985/97. When the contents of Cr in the D alloy powders become lower than 4.0% by weight, the wear amounts of the valve seats are increased because the amount for forming the hard phase by the Cr carbides is decreased and the amount of Cr to be diffused into the matrix to strengthen the matrix is decreased. On the other hand, when the contents of Cr in the D alloy powders exceed 25.0% by weight, the amount for forming the hard phase is increased and therefore, the valve attackability is increased. As a consequence, the wear amounts of the valves are abruptly increased. Moreover, since the compacting property of the powders are deteriorated, the strength of the matrix is lowered. Furthermore, since the worn particles of the valves act as abrasive grains, the wear amounts of the valve seats are increased and the total wear amounts of both the valves and valve seats are increased. As shown in FIG. 6(*b*), the effects of the contents of Cr in the D alloy powders are significantly reflected to the radial crushing strength of the valve seats and high when the contents of Cr are in the range of from 4.0 to 25.0% by weight.

In this way, it was confirmed that when the contents of Cr in the D alloy powders are in the range of from 4.0 to 25.0% by weight, both the wear resistance and the strength are favorable. As apparent from FIG. 6(*a*), when the contents of Cr in the D alloy powders are 20.0% by weight or less, the wear amounts of the valve seat and the valve are stable at a rather low level. Thus, it is more preferable that the contents of Cr in the D alloy powders are 20.0% or less.

Figure 7A:
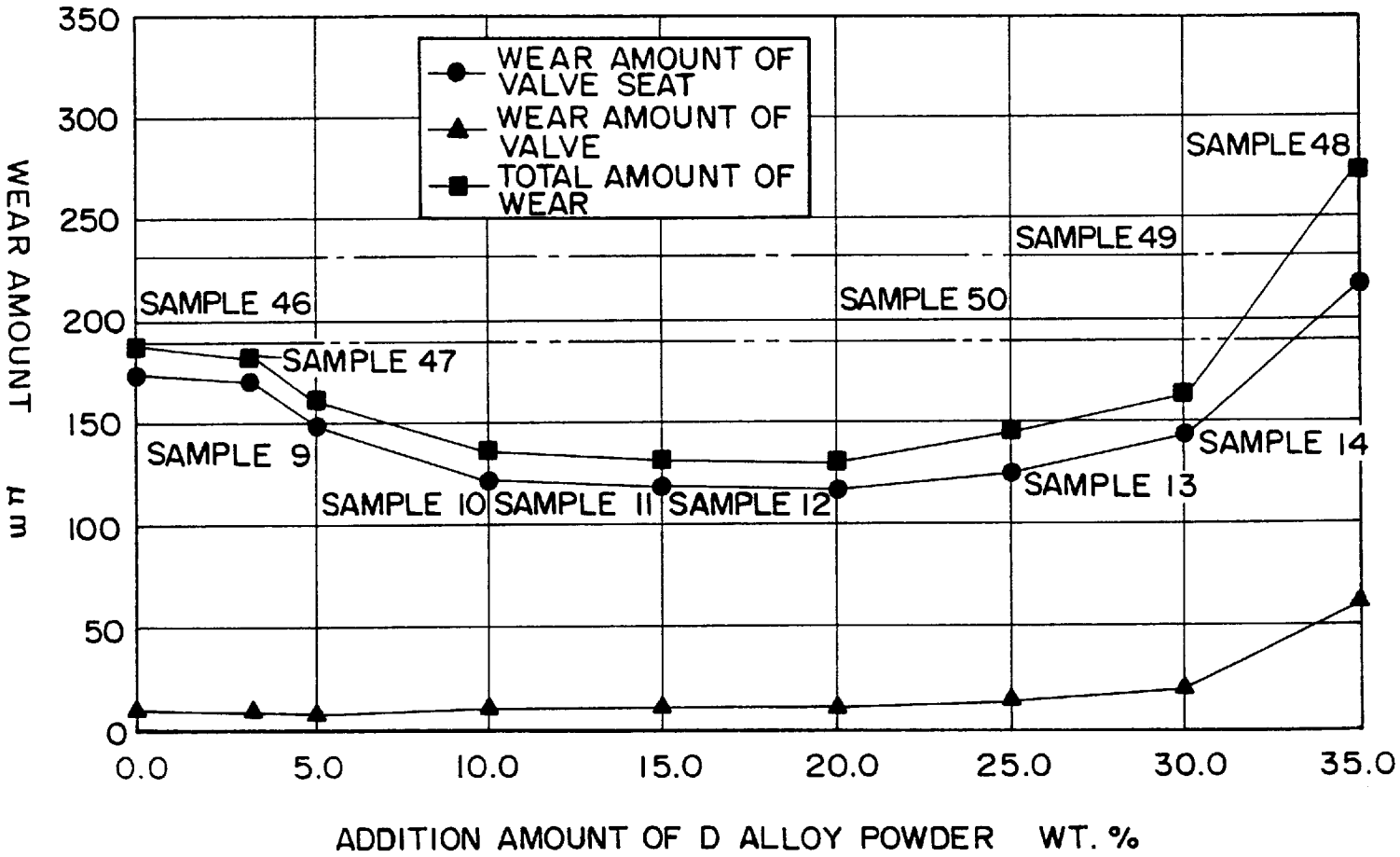
FIG. 7 is a chart showing how the change of the amount of addition of D alloy powder affects the characteristics, in the embodiment of the present invention.
Figure 7B:
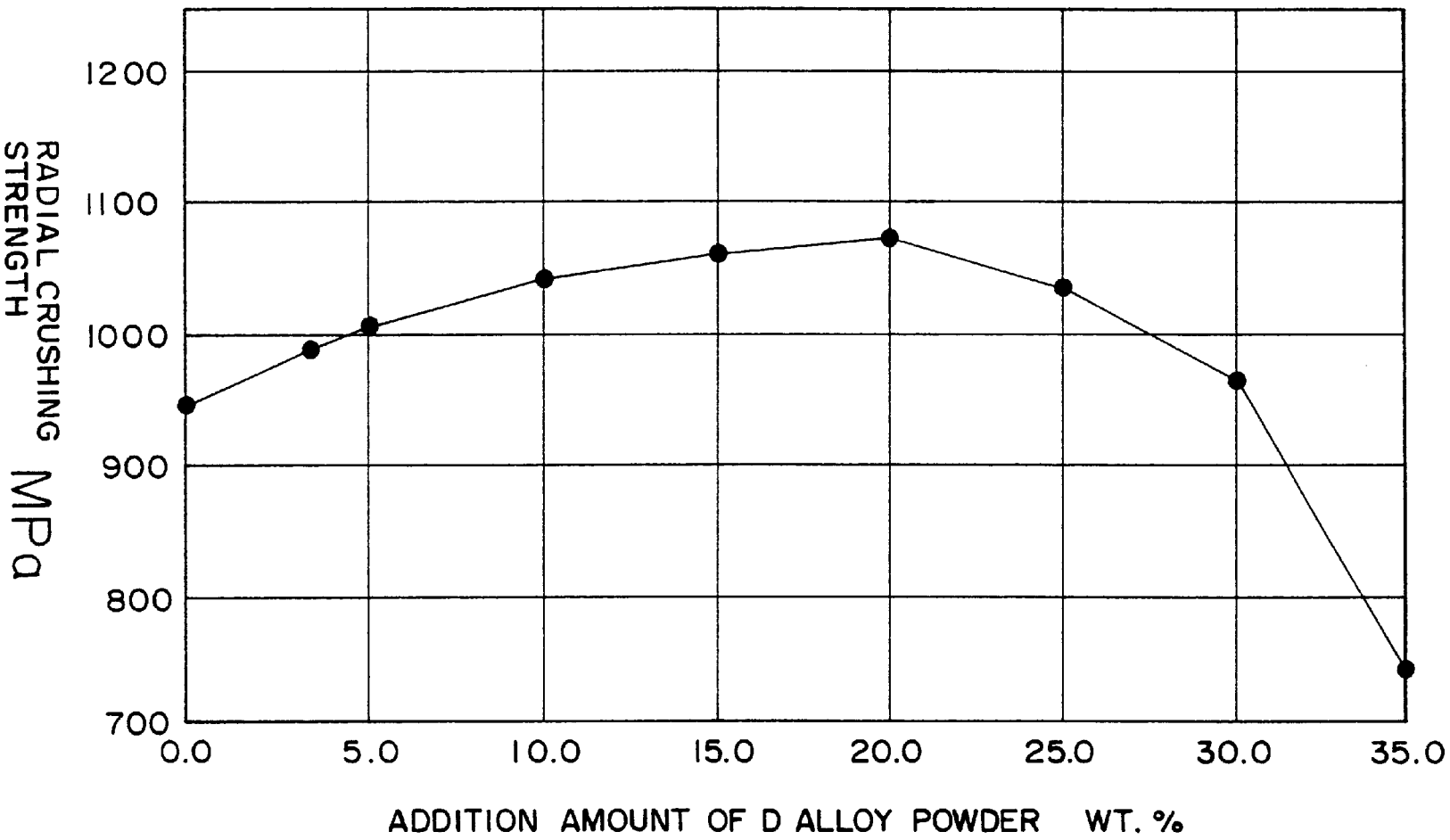

Next, the sample No. 9–14, and 46–48 of Table 3 are different in the addition amounts of the D alloy powders to the mixed powders. By comparing the test results of those sintered alloys, it is checked how the differences of the addition amounts of the D alloy powders affect. The test results are shown in FIG. 7 together with the total amounts of wear of the conventional sintered alloys of sample No. 49 and 50. As shown in FIG. 7(*a*), when the addition amounts of the D alloy powders are 3.0% by weight, the effect of the improvement of the wear resistance is insufficient because the addition amounts are too small. With the increase of the addition amounts from 5.0% by weight, the effect of the improvement of the wear resistance becomes significant. When the addition amounts of the D alloy powders are in the range of from 5.0 to 30.0% by weight, the wear amounts of the valve seats are low and stable. However, when the addition amounts exceed 30.0% by weight, the strength of the matrix is lowered because the compacting property of the powders is deteriorated. As a result, the wear amounts of the valve seats are increased and the valve attackability is increased. Thus, the total wear amounts are increased. Also, the effects of the addition amounts in the D alloy powders are significantly reflected to the radial crushing strength of the valve sheets, as shown in FIG. 7(*b*). The effects are high when the addition amounts are in the range of from 5.0 to 30.0% by weight. In this way, it was confirmed that both the wear resistance and the strength are favorable when the addition amounts of the D alloy powders are in the range of from 5.0 to 30.0% by weight.

Next, the E alloy powders E1 to E7 of Table 2 are obtained by further adding Mo, V, and W to the D alloy powers. By comparing the test results of the sintered alloys of the sample No. 15 to 21 shown in Table 3 and Table 4 using the E alloy powders E1 to E7, it is checked how the effects of the addition of Mo, V, and W to the D alloy powders affect. The test results are shown in FIG. 8 together with the total wear amounts of the sintered alloy power (the D alloy powder is added thereto) of the sample No. 11 containing no Mo, V and W, and the conventional sintered alloys of the sample No. 49 and 50.

Figure 8A:
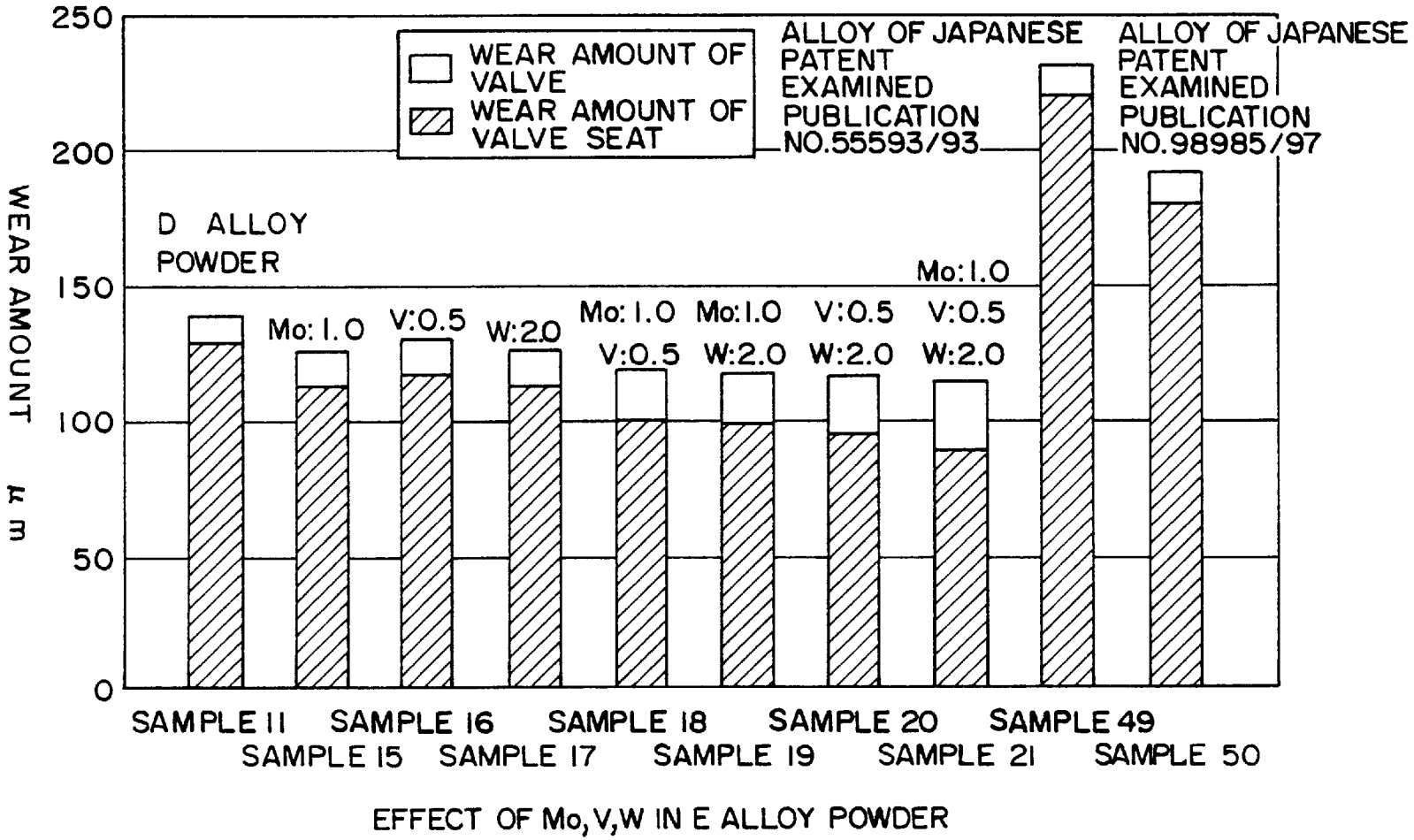
FIG. 8 is a chart showing how the Mo, V and W in E alloy powder affects the characteristics, in the embodiment of the present invention.
Figure 8B:
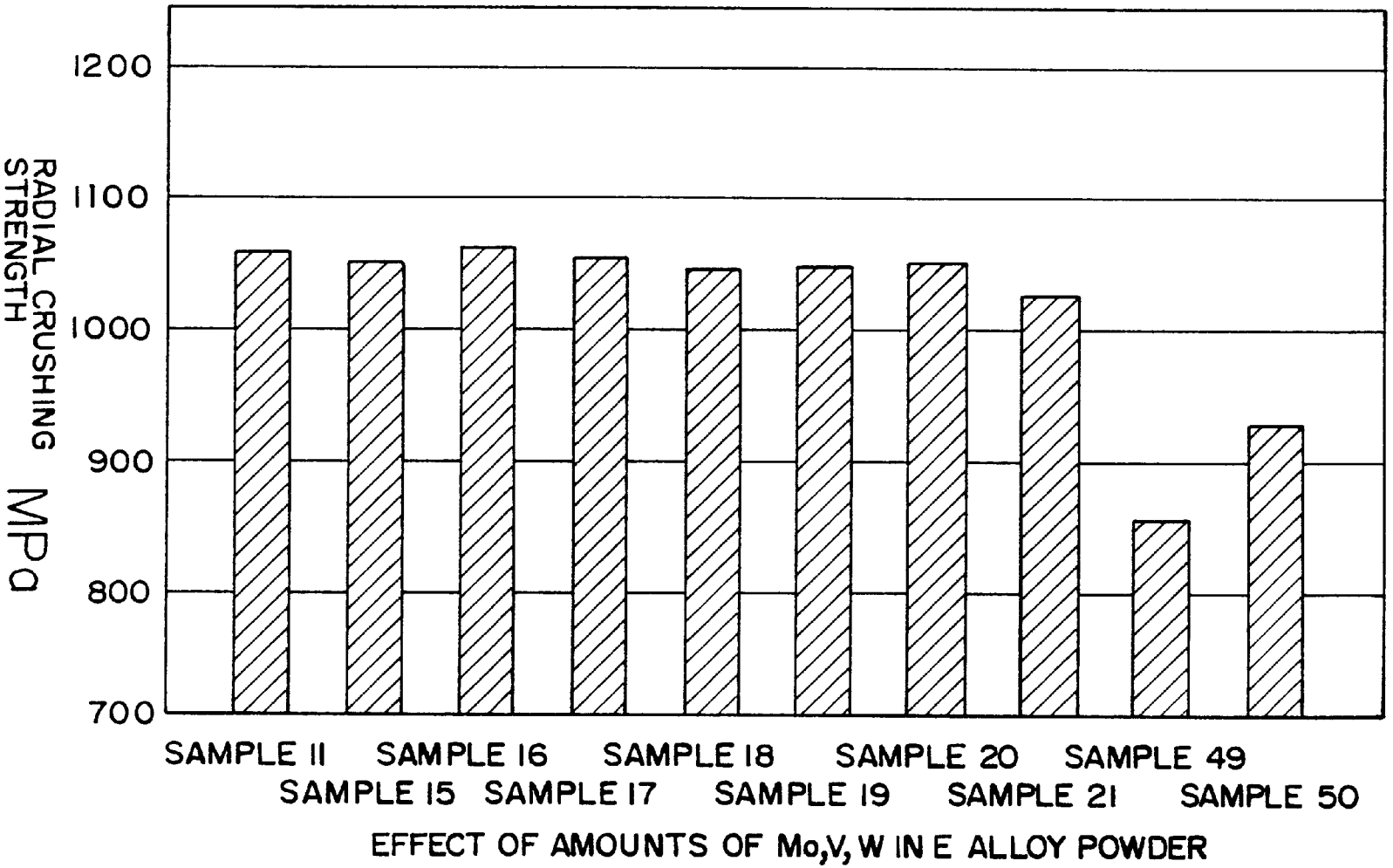

As shown in FIG. 8(*a*), it is known that the sintered alloy consisting of the E alloy powder obtained by adding Mo, V, and W to the D alloy powder is less in the wear amount of the valve seat than the sintered alloys consisting of the D alloy powder without lowering the strength, less in the total wear amount, and further improved in the wear resistance, as shown in FIG. 8(*b*).

TABLE 4

| Sample | Constituent Composition as a Whole wt. % | | | | | | | | | |
|---|---|---|---|---|---|---|---|---|---|---|
| No. | Fe | Ni | Cr | Co | Mo | V | W | Si | C | |
| 1 | B1 | 7.00 | 4.40 | 10.24 | 4.57 | 0.14 | | 0.38 | 0.77 | |
| 2 | B1 | 2.10 | 3.94 | 11.25 | 4.76 | 0.09 | | 0.38 | 0.77 | |
| 3 | B1 | 4.20 | 3.94 | 11.25 | 4.76 | 0.09 | | 0.38 | 0.77 | |
| 4 | B1 | 7.00 | 3.94 | 11.25 | 4.76 | 0.09 | | 0.38 | 0.63 | |
| 5 | B1 | 8.00 | 3.27 | 5.39 | 2.04 | 0.11 | | 0.13 | 0.85 | |
| 6 | B1 | 7.50 | 3.60 | 8.32 | 3.40 | 0.10 | | 0.25 | 0.81 | |
| 7 | B1 | 7.00 | 2.74 | 11.25 | 4.76 | 0.09 | | 0.38 | 0.77 | |
| 8 | B1 | 7.00 | 3.34 | 11.25 | 4.76 | 0.09 | | 0.38 | 0.77 | |
| 9 | B1 | 8.00 | 2.87 | 11.54 | 4.84 | 0.11 | | 0.38 | 0.71 | |
| 10 | B1 | 7.50 | 3.40 | 11.40 | 4.80 | 0.10 | | 0.38 | 0.74 | |
| 11 | B1 | 7.00 | 3.94 | 11.25 | 4.76 | 0.09 | | 0.38 | 0.77 | |
| 12 | B1 | 6.50 | 4.47 | 11.11 | 4.72 | 0.09 | | 0.38 | 0.80 | |
| 13 | B1 | 6.00 | 5.00 | 10.96 | 4.68 | 0.08 | | 0.38 | 0.83 | |
| 14 | B1 | 5.50 | 5.54 | 10.82 | 4.64 | 0.07 | | 0.38 | 0.86 | |
| 15 | B1 | 7.00 | 3.94 | 11.25 | 4.91 | 0.09 | | 0.38 | 0.77 | |
| 16 | B1 | 7.00 | 3.94 | 11.25 | 4.76 | 0.17 | | 0.38 | 0.77 | |
| 17 | B1 | 7.00 | 3.94 | 11.25 | 4.76 | 0.09 | 0.30 | 0.38 | 0.77 | |
| 18 | B1 | 7.00 | 3.94 | 11.25 | 4.91 | 0.17 | | 0.38 | 0.77 | |
| 19 | B1 | 7.00 | 3.94 | 11.25 | 4.91 | 0.09 | 0.30 | 0.38 | 0.77 | |
| 20 | B1 | 7.00 | 3.94 | 11.25 | 4.76 | 0.17 | 0.30 | 0.38 | 0.77 | |
| 21 | B1 | 7.00 | 3.94 | 11.25 | 4.91 | 0.17 | 0.30 | 0.38 | 0.77 | |
| 22 | B1 | 7.00 | 4.39 | 11.25 | 4.76 | 0.09 | | 0.38 | 0.77 | |
| 23 | B1 | 7.00 | 5.14 | 11.25 | 4.76 | 0.09 | | 0.38 | 0.77 | |
| 24 | B1 | 7.00 | 5.89 | 11.25 | 4.76 | 0.09 | | 0.38 | 0.77 | |
| 25 | B1 | 6.50 | 4.27 | 14.18 | 6.12 | 0.09 | | 0.50 | 0.73 | |
| 26 | B1 | 6.00 | 4.60 | 17.11 | 7.48 | 0.08 | | 0.63 | 0.69 | |
| 27 | B1 | 7.00 | 3.94 | 11.25 | 4.76 | 0.09 | | 0.38 | 0.91 | |
| 28 | B1 | 7.00 | 3.94 | 11.25 | 4.76 | 0.09 | | 0.38 | 1.05 | |
| 29 | B1 | 10.50 | 3.94 | 11.25 | 4.76 | 0.09 | | 0.38 | 0.77 | |
| 30 | B1 | 14.00 | 3.94 | 11.25 | 4.76 | 0.09 | | 0.38 | 0.77 | |
| 31 | B1 | 7.00 | 3.47 | 12.27 | 4.95 | 0.05 | | 0.38 | 0.77 | |
| 32 | B1 | 7.00 | 4.87 | | 4.39 | 0.19 | | 0.38 | 0.77 | N |
| 33 | B1 | 7.00 | 4.50 | 10.04 | 4.54 | 0.15 | | 0.38 | 0.77 | N |
| 34 | B1 | 7.00 | 3.37 | 12.47 | 4.99 | 0.04 | | 0.38 | 0.77 | N |
| 35 | B1 | 7.00 | 3.00 | 13.28 | 5.14 | | | 0.38 | 0.77 | N |
| 36 | B1 | 0.00 | 3.94 | 11.25 | 4.76 | 0.09 | | 0.38 | 0.77 | N |
| 37 | B1 | 0.53 | 3.94 | 11.25 | 4.76 | 0.09 | | 0.38 | 0.77 | N |
| 38 | B1 | 15.40 | 3.94 | 11.25 | 4.76 | 0.09 | | 0.38 | 0.77 | N |
| 39 | B1 | 7.00 | 3.94 | 11.25 | 4.76 | 0.09 | | 0.38 | 0.49 | N |
| 40 | B1 | 7.00 | 3.94 | 11.25 | 4.76 | 0.09 | | 0.38 | 1.19 | N |
| 41 | B1 | 8.50 | 2.94 | 2.46 | 0.68 | 0.11 | | | 0.89 | N |
| 42 | B1 | 8.20 | 3.14 | 4.22 | 1.50 | 0.11 | | 0.08 | 0.87 | N |
| 43 | B1 | 5.50 | 4.94 | 20.04 | 8.84 | 0.07 | | 0.75 | 0.65 | N |
| 44 | B1 | 7.00 | 2.44 | 11.25 | 4.76 | 0.09 | | 0.38 | 0.77 | N |
| 45 | B1 | 7.00 | 6.19 | 11.25 | 4.76 | 0.09 | | 0.38 | 0.77 | N |
| 46 | B1 | 8.50 | 2.34 | 11.69 | 4.88 | 0.11 | | 0.38 | 0.68 | N |
| 47 | B1 | 8.20 | 2.66 | 11.60 | 4.86 | 0.11 | | 0.38 | 0.70 | N |
| 48 | B1 | 5.00 | 6.07 | 10.67 | 4.60 | 0.07 | | 0.38 | 0.89 | N |
| 49 | B1 | | 1.20 | 13.57 | 5.20 | | | 0.38 | 0.60 | P1 |
| 50 | B1 | 7.50 | 1.20 | 13.57 | 5.20 | | | 0.38 | 0.60 | P1 |

(Note)
"B1" means "Balance"
"N" means "not within the scope of the claim of the present invention"
"P1" means "Alloy of Japanese Patent Examined Publication Number 55593/93"
"P2" means "Alloy of Japanese Patent Examined Publication Number 98985/95"

TABLE 5

| Sample No. | Evaluated Item: Wear Amount μm: Valve Seat | Valve | Total | Radial Crushing Strength MPa |
|---|---|---|---|---|
| 1 | 136 | 11 | 147 | 1074 |
| 2 | 156 | 7 | 163 | 970 |
| 3 | 131 | 9 | 140 | 1032 |
| 4 | 140 | 8 | 148 | 1025 |
| 5 | 165 | 11 | 176 | 1110 |
| 6 | 142 | 10 | 152 | 1084 |
| 7 | 153 | 5 | 158 | 980 |
| 8 | 136 | 7 | 143 | 1040 |
| 9 | 149 | 9 | 158 | 1006 |
| 10 | 129 | 9 | 138 | 1036 |
| 11 | 126 | 10 | 136 | 1056 |
| 12 | 123 | 11 | 134 | 1072 |
| 13 | 130 | 15 | 145 | 1030 |
| 14 | 142 | 21 | 163 | 960 |
| 15 | 110 | 14 | 124 | 1048 |
| 16 | 144 | 13 | 127 | 1058 |
| 17 | 109 | 14 | 123 | 1054 |
| 18 | 101 | 18 | 119 | 1040 |
| 19 | 99 | 19 | 118 | 1042 |
| 20 | 96 | 21 | 117 | 1050 |
| 21 | 90 | 25 | 115 | 1024 |
| 22 | 120 | 14 | 134 | 1041 |
| 23 | 122 | 17 | 139 | 1000 |
| 24 | 154 | 35 | 189 | 900 |
| 25 | 119 | 15 | 134 | 1020 |
| 26 | 134 | 24 | 158 | 950 |
| 27 | 113 | 16 | 129 | 1100 |
| 28 | 107 | 24 | 131 | 1080 |
| 29 | 120 | 10 | 130 | 1068 |

TABLE 5-continued

| Sample No. | Evaluated Item: Wear Amount μm: Valve Seat | Valve | Total | Radial Crushing Strength MPa | |
|---|---|---|---|---|---|
| 30 | 144 | 6 | 150 | 1005 | |
| 31 | 134 | 12 | 146 | 1061 | |
| 32 | 170 | 32 | 202 | 1100 | N |
| 33 | 158 | 25 | 183 | 1080 | N |
| 34 | 148 | 20 | 168 | 1070 | N |
| 35 | 166 | 24 | 190 | 1091 | N |
| 36 | 250 | 9 | 259 | 834 | N |
| 37 | 220 | 7 | 227 | 869 | N |
| 38 | 187 | 6 | 193 | 875 | N |
| 39 | 189 | 4 | 193 | 920 | N |
| 40 | 163 | 80 | 243 | 960 | N |
| 41 | 279 | 14 | 293 | 1133 | N |
| 42 | 200 | 13 | 213 | 1123 | N |
| 43 | 167 | 51 | 218 | 740 | N |
| 44 | 212 | 3 | 215 | 840 | N |
| 45 | 202 | 76 | 278 | 820 | N |
| 46 | 180 | 10 | 190 | 945 | N |
| 47 | 171 | 10 | 181 | 988 | N |
| 48 | 218 | 56 | 274 | 730 | N |
| 49 | 220 | 11 | 231 | 850 | P1 |
| 50 | 181 | 12 | 193 | 930 | P2 |

(Note)
"N" means "Not within the scope of the claim of the present invention"
"P1" means "Alloy of Japanese Patent Examined Publication Number 55593/93"
"P2" means "Alloy of Japanese Patent Examined Publication Number 98985/95"

TABLE 6

| Sample No. | Mixing Ratio wt. %: Preliminarily Mixed Powder: No. | Addition Amount | C Alloy Powder Addition Amount | D Alloy Powder: No. | Addition Amount | MnS Powder Addition Amount | Pb Powder Addition Amount | BN Powder Addition Amount | $MgSiO_3$ Powder Addition Amount | |
|---|---|---|---|---|---|---|---|---|---|---|
| 11 | Y5 | 70.00 | 15.00 | D3 | 15.00 | | | | | |
| 51 | Y5 | 69.70 | 15.00 | D3 | 15.00 | 0.30 | | | | |
| 52 | Y5 | 69.50 | 15.00 | D3 | 15.00 | 0.50 | | | | |
| 53 | Y5 | 69.00 | 15.00 | D3 | 15.00 | 1.00 | | | | |
| 54 | Y5 | 68.00 | 15.00 | D3 | 15.00 | 2.00 | | | | |
| 55 | Y5 | 69.70 | 15.00 | D3 | 15.00 | | 0.30 | | | |
| 56 | Y5 | 69.50 | 15.00 | D3 | 15.00 | | 0.50 | | | |
| 57 | Y5 | 69.00 | 15.00 | D3 | 15.00 | | 1.00 | | | |
| 58 | Y5 | 68.00 | 15.00 | D3 | 15.00 | | 2.00 | | | |
| 59 | Y5 | 69.70 | 15.00 | D3 | 15.00 | | | 0.30 | | |
| 60 | Y5 | 69.50 | 15.00 | D3 | 15.00 | | | 0.50 | | |
| 61 | Y5 | 69.00 | 15.00 | D3 | 15.00 | | | 1.00 | | |
| 62 | Y5 | 68.00 | 15.00 | D3 | 15.00 | | | 2.00 | | |
| 63 | Y5 | 69.70 | 15.00 | D3 | 15.00 | | | | 0.30 | |
| 64 | Y5 | 69.50 | 15.00 | D3 | 15.00 | | | | 0.50 | |
| 65 | Y5 | 69.00 | 15.00 | D3 | 15.00 | | | | 1.00 | |
| 66 | Y5 | 68.00 | 15.00 | D3 | 15.00 | | | | 2.00 | |
| 67 | Y5 | 69.80 | 15.00 | D3 | 15.00 | 0.20 | | | | N |
| 68 | Y5 | 67.00 | 15.00 | D3 | 15.00 | 3.00 | | | | N |
| 69 | Y5 | 69.80 | 15.00 | D3 | 15.00 | | 0.20 | | | N |
| 70 | Y5 | 67.00 | 15.00 | D3 | 15.00 | | 3.00 | | | N |
| 71 | Y5 | 69.80 | 15.00 | D3 | 15.00 | | | 0.20 | | N |
| 72 | Y5 | 67.00 | 15.00 | D3 | 15.00 | | | 3.00 | | N |
| 73 | Y5 | 69.80 | 15.00 | D3 | 15.00 | | | | 0.20 | N |
| 74 | Y5 | 67.00 | 15.00 | D3 | 15.00 | | | | 3.00 | N |
| 75 | Y5 | 70.00 | 15.00 | D3 | 15.00 | | | | | Pb Infiltration |
| 76 | Y5 | 70.00 | 15.00 | D3 | 15.00 | | | | | Cu Infiltration |

TABLE 6-continued

| | Mixing Ratio wt. % | | | | | | | | | |
|---|---|---|---|---|---|---|---|---|---|---|
| | Preliminarily Mixed Powder | | C Alloy Powder | D Alloy Powder | | MnS Powder | Pb Powder | BN Powder | $MgSiO_3$ Powder | |
| Sample No. | No. | Addition Amount | Addition Amount | No. | Addition Amount | Addition Amount | Addition Amount | Addition Amount | Addition Amount | |
| 77 | Y5 | 70.00 | 15.00 | D3 | 15.00 | | | | | Resin Impregnation |

(Note)
"N" means "not within the scope of the claim of the present invention"

TABLE 7

| Sample | Constituent Composition as a Whole wt. % | | | | | | | | | | | | |
|---|---|---|---|---|---|---|---|---|---|---|---|---|---|
| No. | Fe | Ni | Cr | Co | Mo | V | Si | C | MnS | Pb | BN | $MgSiO_3$ | |
| 11 | Balance | 7.00 | 3.94 | 11.25 | 4.76 | 0.09 | 0.38 | 0.77 | | | | | |
| 51 | Balance | 6.97 | 3.93 | 11.25 | 4.76 | 0.09 | 0.38 | 0.77 | 0.30 | | | | |
| 52 | Balance | 6.95 | 3.93 | 11.24 | 4.76 | 0.09 | 0.38 | 0.77 | 0.50 | | | | |
| 53 | Balance | 6.90 | 3.92 | 11.23 | 4.75 | 0.09 | 0.38 | 0.76 | 1.00 | | | | |
| 54 | Balance | 6.80 | 3.91 | 11.20 | 4.75 | 0.09 | 0.38 | 0.75 | 2.00 | | | | |
| 55 | Balance | 6.97 | 3.93 | 11.25 | 4.76 | 0.09 | 0.38 | 0.77 | | 0.30 | | | |
| 56 | Balance | 6.95 | 3.93 | 11.24 | 4.76 | 0.09 | 0.38 | 0.77 | | 0.50 | | | |
| 57 | Balance | 6.90 | 3.92 | 11.23 | 4.75 | 0.09 | 0.38 | 0.76 | | 1.00 | | | |
| 58 | Balance | 6.80 | 3.91 | 11.20 | 4.75 | 0.09 | 0.38 | 0.75 | | 2.00 | | | |
| 59 | Balance | 6.97 | 3.93 | 11.25 | 4.76 | 0.09 | 0.38 | 0.77 | | | 0.30 | | |
| 60 | Balance | 6.95 | 3.93 | 11.24 | 4.76 | 0.09 | 0.38 | 0.77 | | | 0.50 | | |
| 61 | Balance | 6.90 | 3.92 | 11.23 | 4.75 | 0.09 | 0.38 | 0.76 | | | 1.00 | | |
| 62 | Balance | 6.80 | 3.91 | 11.20 | 4.75 | 0.09 | 0.38 | 0.75 | | | 2.00 | | |
| 63 | Balance | 6.97 | 3.93 | 11.25 | 4.76 | 0.09 | 0.38 | 0.77 | | | | 0.30 | |
| 64 | Balance | 6.95 | 3.93 | 11.24 | 4.76 | 0.09 | 0.38 | 0.77 | | | | 0.50 | |
| 65 | Balance | 6.90 | 3.92 | 11.23 | 4.75 | 0.09 | 0.38 | 0.76 | | | | 1.00 | |
| 66 | Balance | 6.80 | 3.91 | 11.20 | 4.75 | 0.09 | 0.38 | 0.75 | | | | 2.00 | |
| 67 | Balance | 6.98 | 3.93 | 11.25 | 4.76 | 0.09 | 0.38 | 0.77 | 0.20 | | | | N |
| 68 | Balance | 6.70 | 3.90 | 11.17 | 4.74 | 0.09 | 0.38 | 0.75 | 3.00 | | | | N |
| 69 | Balance | 6.98 | 3.93 | 11.25 | 4.76 | 0.09 | 0.38 | 0.77 | | 0.20 | | | N |
| 70 | Balance | 6.70 | 3.90 | 11.17 | 4.74 | 0.09 | 0.38 | 0.75 | | 3.00 | | | N |
| 71 | Balance | 6.98 | 3.93 | 11.25 | 4.76 | 0.09 | 0.38 | 0.77 | | | 0.20 | | N |
| 72 | Balance | 6.70 | 3.90 | 11.17 | 4.74 | 0.09 | 0.38 | 0.75 | | | 3.00 | | N |
| 73 | Balance | 6.98 | 3.93 | 11.25 | 4.76 | 0.09 | 0.38 | 0.77 | | | | 0.20 | N |
| 74 | Balance | 6.70 | 3.90 | 11.17 | 4.74 | 0.09 | 0.38 | 0.75 | | | | 3.00 | N |
| 75 | Balance | 7.00 | 3.94 | 11.25 | 4.76 | 0.09 | 0.38 | 0.77 | | | | | Pb Infiltration |
| 76 | Balance | 7.00 | 3.94 | 11.25 | 4.76 | 0.09 | 0.38 | 0.77 | | | | | Cu Infiltration |
| 77 | Balance | 7.00 | 3.94 | 11.25 | 4.76 | 0.09 | 0.38 | 0.77 | | | | | Resin Impregnation |

(Note)
"N" means "not within the scope of the claim of the present invention"

TABLE 8

| | Evaluated Item | | | | |
|---|---|---|---|---|---|
| | Wear Amount μm | | | Radial Crushing | Machining |
| Sample No. | Valve Seat | Valve | Total | Strength MPa | Pore Number |
| 11 | 126 | 10 | 136 | 1056 | 9 |
| 51 | 127 | 8 | 135 | 1053 | 14 |
| 52 | 135 | 10 | 145 | 1034 | 16 |
| 53 | 144 | 9 | 153 | 1000 | 19 |
| 54 | 155 | 12 | 167 | 970 | 21 |
| 55 | 126 | 9 | 135 | 1054 | 14 |
| 56 | 127 | 8 | 135 | 1050 | 16 |
| 57 | 130 | 7 | 137 | 1043 | 19 |
| 58 | 142 | 12 | 154 | 1021 | 22 |
| 59 | 131 | 10 | 141 | 1046 | 11 |
| 60 | 136 | 11 | 147 | 1040 | 12 |
| 61 | 143 | 13 | 156 | 1029 | 13 |
| 62 | 153 | 12 | 165 | 992 | 16 |

TABLE 8-continued

| | Evaluated Item | | | | | |
|---|---|---|---|---|---|---|
| | Wear Amount μm | | | Radial Crushing | Machining | |
| Sample No. | Valve Seat | Valve | Total | Strength MPa | Pore Number | |
| 63 | 127 | 8 | 135 | 1051 | 11 | |
| 64 | 134 | 7 | 141 | 1045 | 13 | |
| 65 | 140 | 9 | 149 | 1031 | 16 | |
| 66 | 156 | 11 | 167 | 996 | 19 | |
| 67 | 125 | 10 | 135 | 1054 | 12 | N |
| 68 | 186 | 21 | 207 | 880 | 23 | N |
| 69 | 125 | 9 | 134 | 1054 | 13 | N |
| 70 | 182 | 21 | 203 | 971 | 24 | N |
| 71 | 130 | 9 | 139 | 1050 | 9 | N |
| 72 | 181 | 18 | 199 | 870 | 19 | N |
| 73 | 125 | 8 | 133 | 1053 | 11 | N |
| 74 | 185 | 19 | 204 | 940 | 22 | N |
| 75 | 101 | 7 | 108 | 1063 | 24 | Pb Infiltration |

TABLE 8-continued

| Sample No. | Evaluated Item: Wear Amount μm: Valve Seat | Valve | Total | Radial Crushing Strength MPa | Machining Pore Number | |
|---|---|---|---|---|---|---|
| 76 | 118 | 11 | 129 | 1112 | 18 | Cu Infiltration |
| 77 | 122 | 10 | 132 | 1057 | 41 | Resin Impregnation |

(Note)
"N" means "not within the scope of the claim of the present invention"

TABLE 9

| Sample No. | Mixing Ratio wt. %: Preliminarily Mixed Powder No. | Preliminarily Mixed Powder Addition Amount | C Alloy Powder Addition Amount | D Alloy Powder No. | D Alloy Powder Addition Amount | Low Temperature Treatment | Evaluated Item: Wear Amount μm: Valve Seat | Valve | Total | Radial Crushing Strength Mpa |
|---|---|---|---|---|---|---|---|---|---|---|
| 11 | Y10 | 70.00 | 15.00 | D4 | 15.00 | No | 126 | 10 | 136 | 1056 |
| 78 | Y10 | 70.00 | 15.00 | D4 | 15.00 | Yes | 108 | 13 | 121 | 1112 |

Evaluation Test 2

Next, the preliminarily mixed power of the powder No. Y5 of Table 1, the C alloy powder of Fe-28Mo-8Cr-2.5Si, and the D alloy powder of the powder No. 3 of Table 2 were added and mixed with manganese sulfide powder, lead powder, boron nitride powder, or $MgSiO_3$ powder as metamagnesium silicate metal powder at the adding and mixing ratios shown in Table 6, and compacted and sintered in the same conditions as in the Evaluation Test 1. By doing so, alloys 51 to 66 of the present invention having the chemical compositions shown in Table 7, and comparative alloys 67 to 74 whose free-cutting components were not within the scope of the present invention were prepared. Further, by infiltrating or impregnating lead, copper or acrylic resin into the pores of the alloy of the present invention of the sample No, 11, the alloy 75 to 77 of the present invention were prepared.

The sintered alloys thus prepared were subjected to radial crushing strength test, simplified wear test, and machinability test. The results are shown in Table 8 and FIGS. 9 through 13. The machinability test is a test where a sample is drilled with a prescribed load using a bench drill and the number of the able machining processes are compared. In the present test, the load was set to 1.0 kg, the drill used was a ϕ3 cemented carbide drill. The thickness of the sample was set to 3 mm.

Figure 9A:
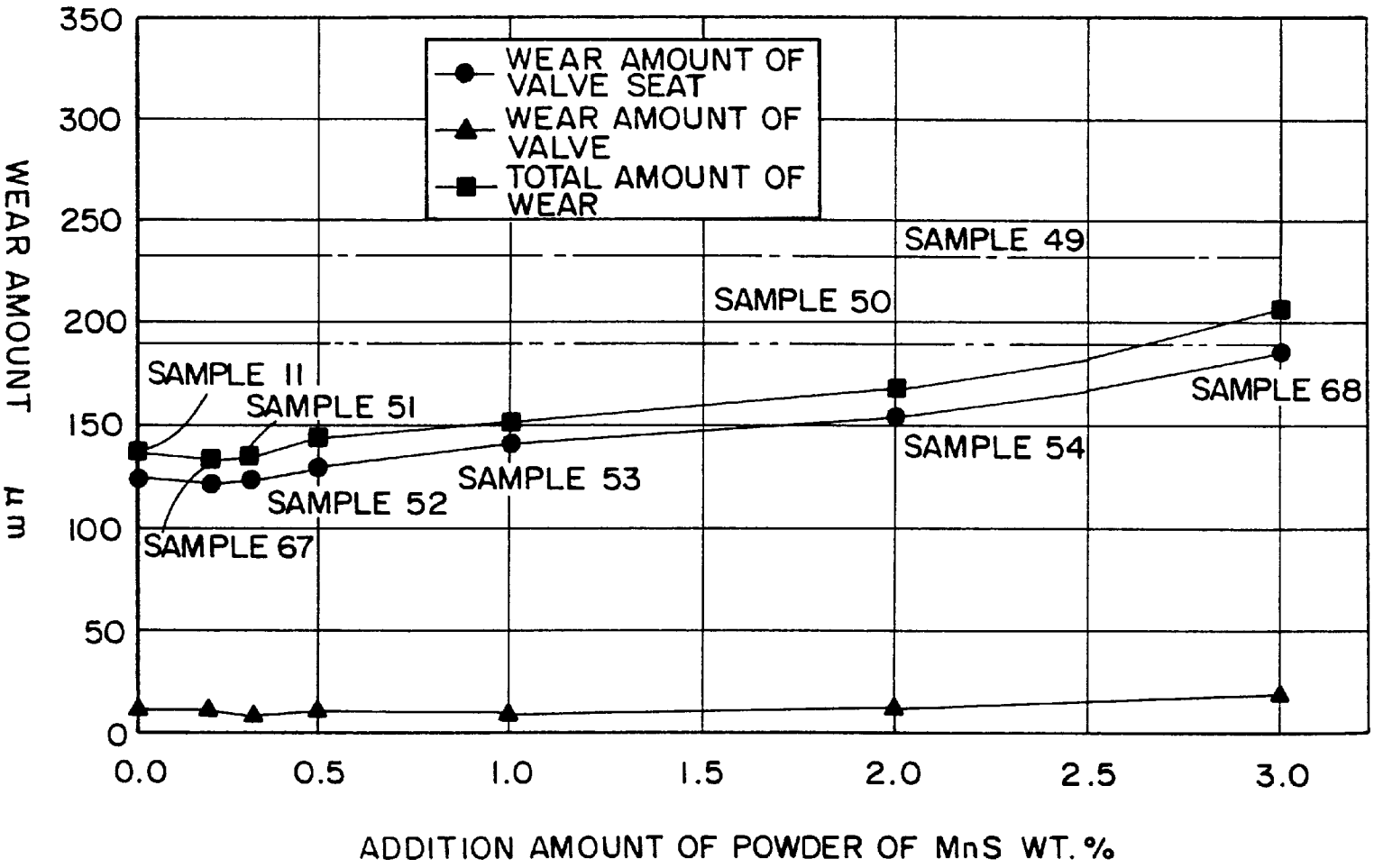
FIG. 9 is a chart showing how the change of the amount of addition of manganese sulfide affects the characteristics, in the embodiment of the present invention.
Figure 9B:
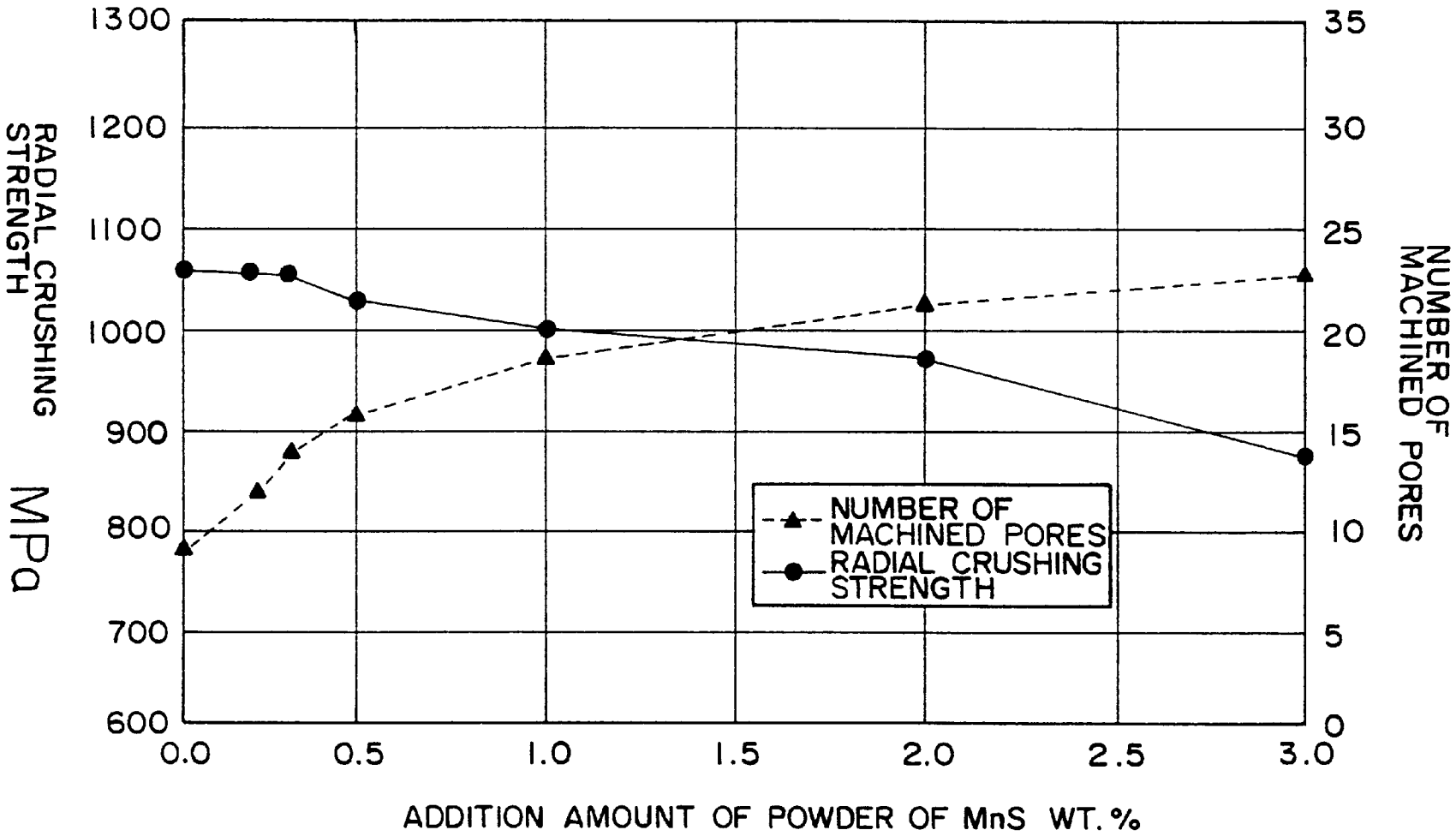

Next, by comparing the test results of the sintered alloys of the sample No. 11, 51 to 54, 67, and 68 of Table 6 and Table 7, the effect of the addition amounts of manganese sulfide is checked. The test results are shown in FIG. 9 together with the total wear amounts of the conventional sintered alloys of the sample No. 49 and 50. As shown in FIG. 9(*b*), it is known that with the increase of addition of the manganese sulfide powders, the machinability is improved under the effect of the manganese sulfide powders dispersed in the matrix, but the radial crushing strength is lowered because the diffusion of powders are interrupted by the manganese sulfide powders when the sintering is carried out, and as a result, the strength of the matrix is lowered. Also, as shown in FIG. 9(*a*), the wear amounts of the valve seats are small although it is slightly increased and exhibit favorable wear resistance until the addition amounts of the manganese sulfide reach 2.0% by weight. When the addition amounts exceed 2.0% by weight, the wear amounts are increased under the effect of the lowering of the strength of the matrix. From this, it became apparent that the machinability can be improved within the limit that the strength and wear resistance are not deteriorated, when the addition amounts of the manganese sulfide powders are 2.0% by weight or less.

Figure 10A:
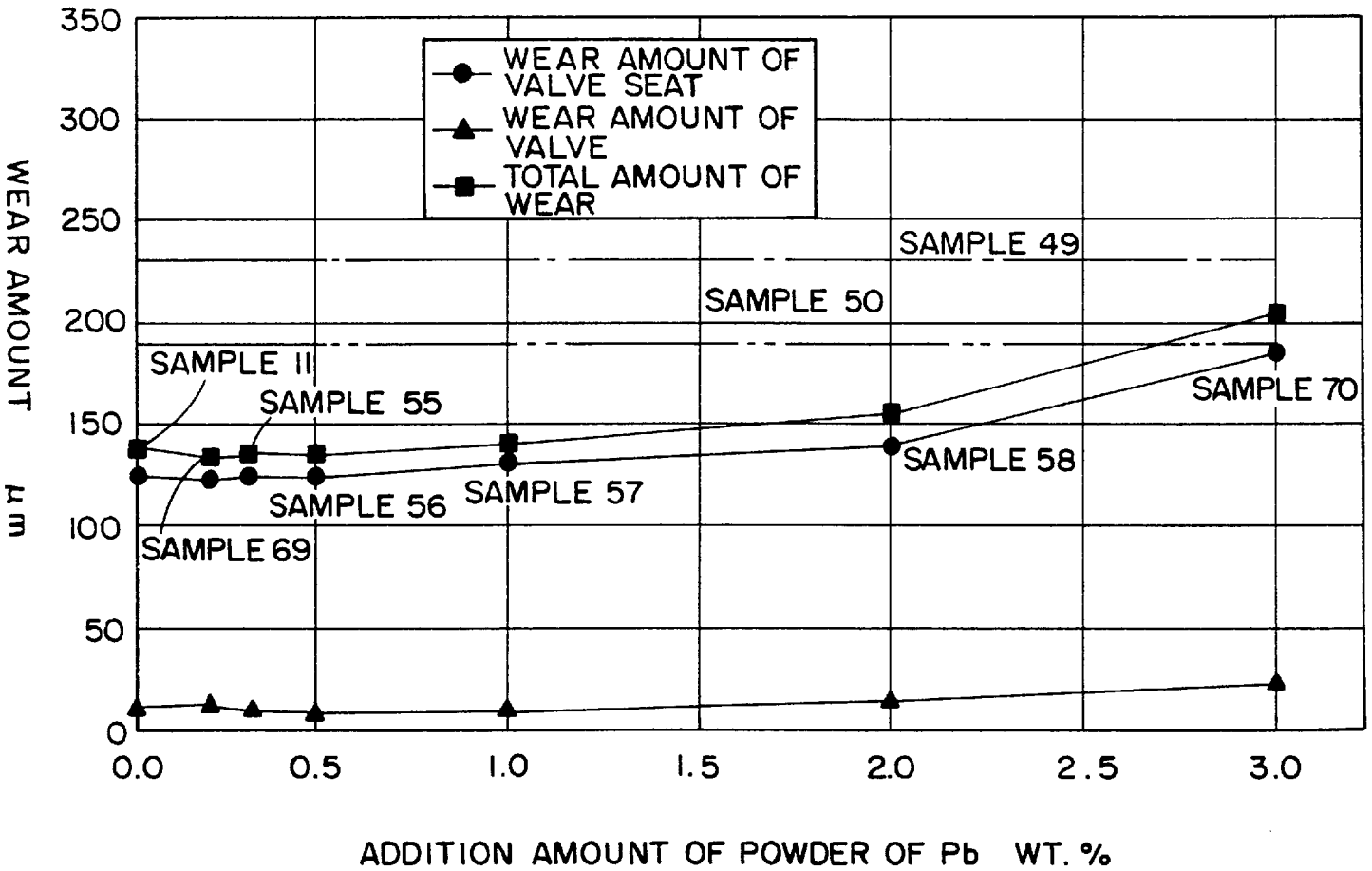
FIG. 10 is a chart showing how the change of the amount of addition of lead powder affects the characteristics, in the embodiment of the present invention.
Figure 10B:
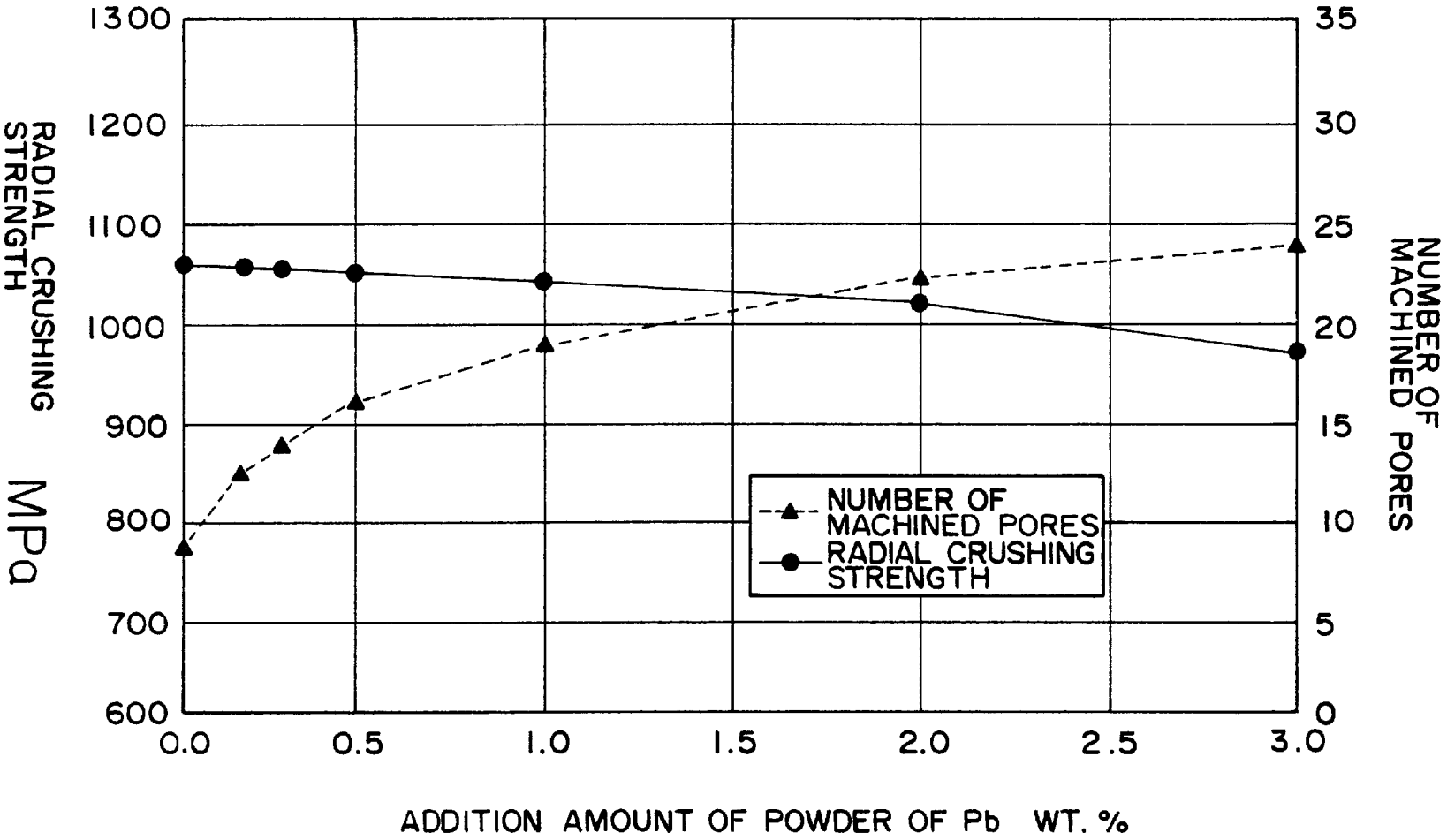

Next, by comparing the test results of the sintered alloys of the sample No. 11, 55 to 58, 69, and 70 of Table 6 and Table 7, the effect of the addition amounts of the lead powders is checked. The test results are shown in FIG. 10 together with the total amounts of wear of the conventional sintered alloys of the sample No. 49, and 50. As shown in FIG. 10(*b*), it is known that as the addition amounts of the lead powders are increased, the machinability is improved. Also, it is known that a metallographic structure is exhibited in which fine lead phases are dispersed in the matrix until the time the addition amounts of the lead powders reach 2.0% by weight, and favorable in strength and wear resistance which are generally the same as in the case where no addition is made, but that when the addition amounts of lead exceed 2.0% by weight, the wear resistance is lowered (see FIG. 10(*a*)). The reason is considered as follows. When the lead powders are added in the amount exceeding 2.0% by weight, the lead powders are aggregated to produce a large and coarse lead phase(s) in the matrix. By this large and coarse lead phase(s) formed in the matrix, large force is acted on the matrix in such a way as to spread the matrix due to expansion of the lead under elevated temperatures. As a result, the strength of the matrix is lowered. This phenomenon did not occur during the radial crushing test under a normal temperature. From this fact, it is known that the machinability can be improved by adding the lead powder in the amount of 2.0% by weight or less, without deteriorating the strength and wear resistance.

Figure 11A:
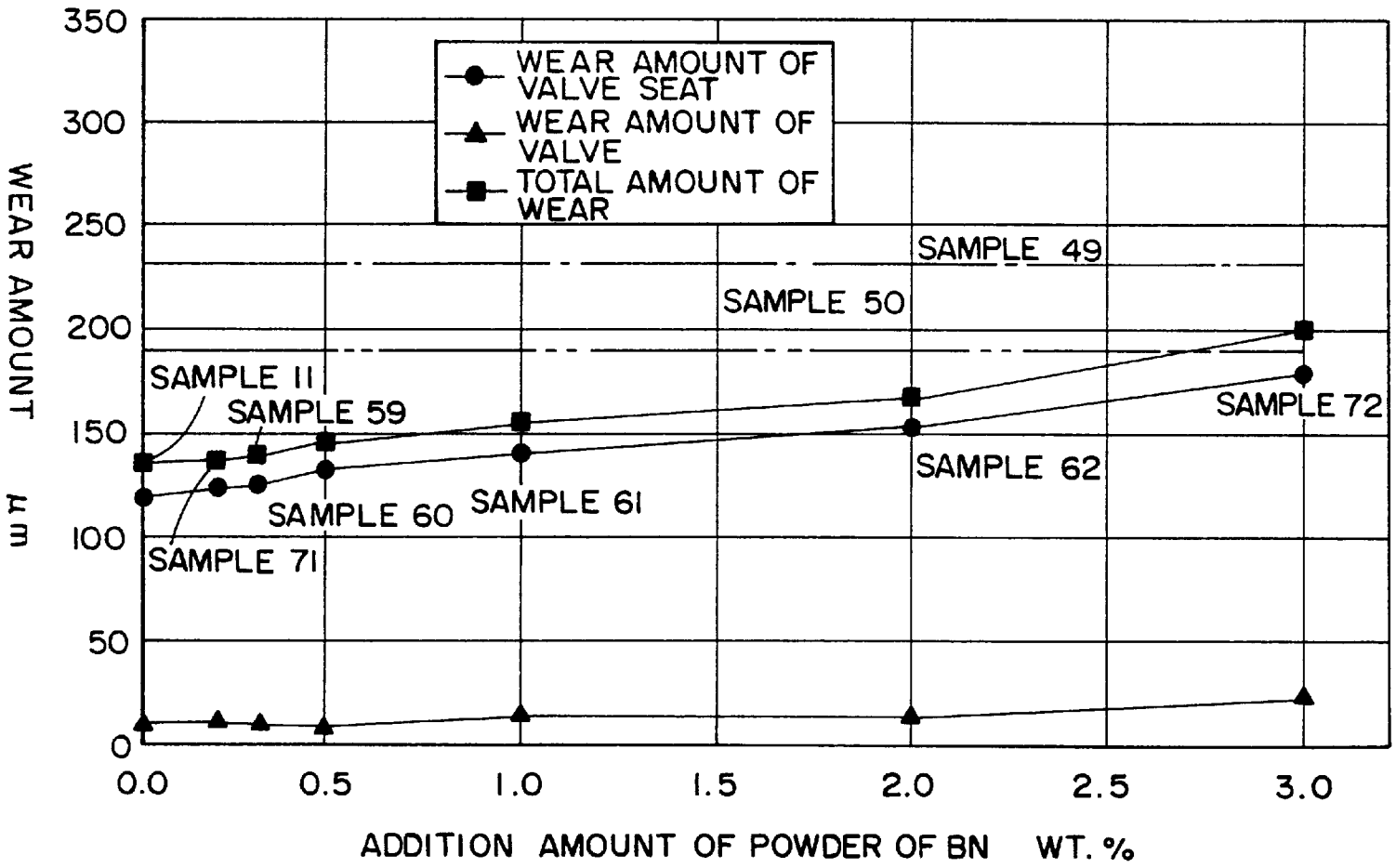
FIG. 11 is a chart showing how the change of the amount of addition of boron nitride powder affects the characteristics, in the embodiment of the present invention.
Figure 11B:
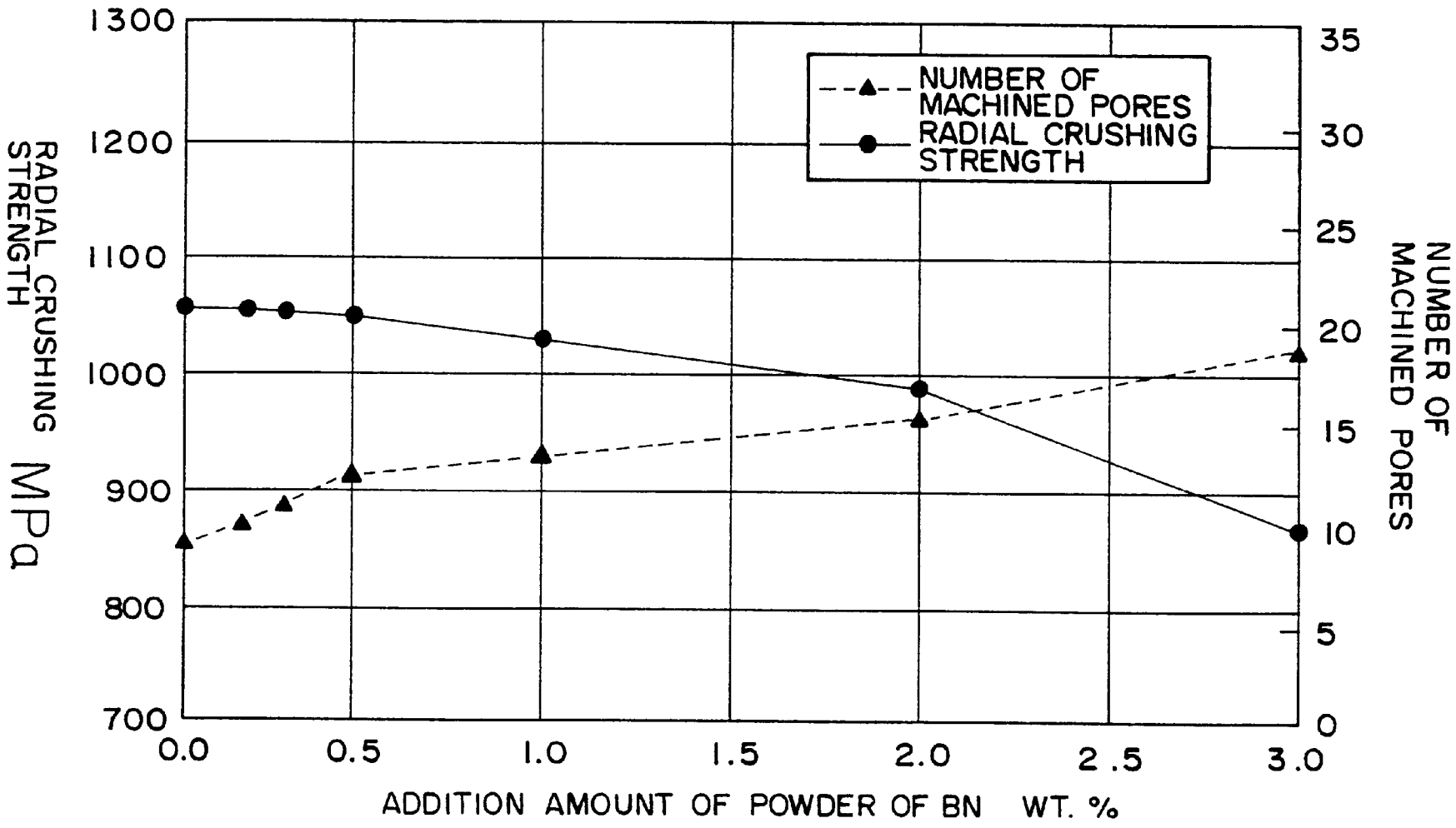

Next, by comparing the sample No. 11, 59 to 62, 71, and 72 of Table 6 and Table 7, it is checked how the addition amounts of the boron nitride (BN) powders affect. The test results are shown in FIG. 11 together with the total amounts of wear of the conventional sintered alloys of the sample No. 49 and 50. It is known that although the machinability is improved under the effect of the boron nitride particles dispersed in the matrix in accordance with the increase of the addition of the boron nitride powders, amounts of the diffusion of the powders is interrupted by the boron nitride powders during the sintering and as a result, the strength of the matrix is lowered and the radial crushing strength is lowered, too, as shown in FIG. 11(*b*). Further, as shown in FIG. 11(*a*), the wear amounts of the valve seats are small although it is slightly increased and exhibit favorable wear resistance until the addition amounts of the boron nitride powders reach 2.0% by weight. When the addition amounts exceed 2.0% by weight, the wear amounts are increased under the effect of the lowering of the strength of the matrix. From this, it is known that the machinability can be improved within the limit that the strength and the wear resistance are not deteriorated, when the addition amounts of the boron nitride powders are 2.0% by weight or less.

Figure 12A:
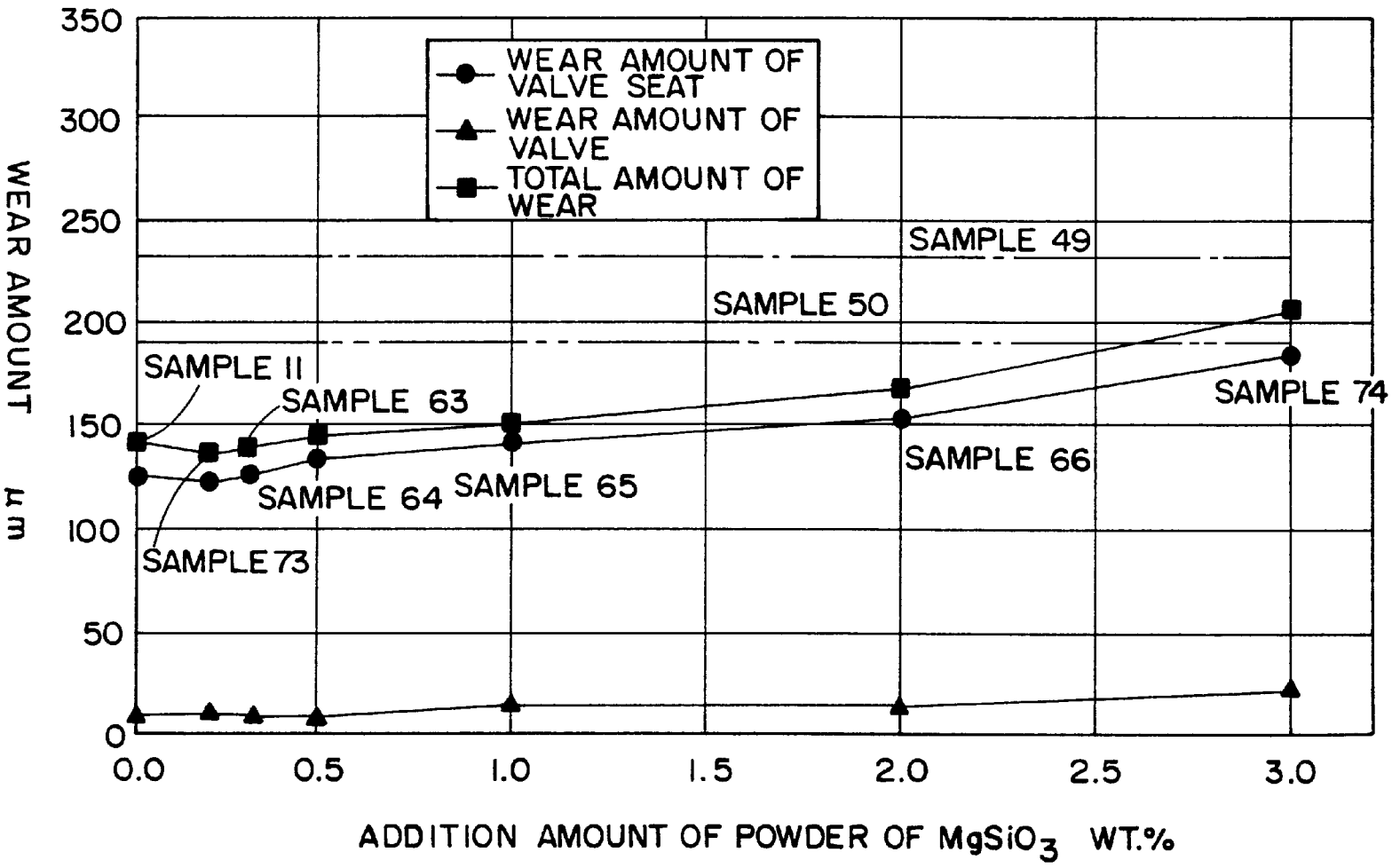
FIG. 12 is a chart showing how the change of the amount of addition of $MgSiO_3$ affects the characteristics, in the embodiment of the present invention.
Figure 12B:
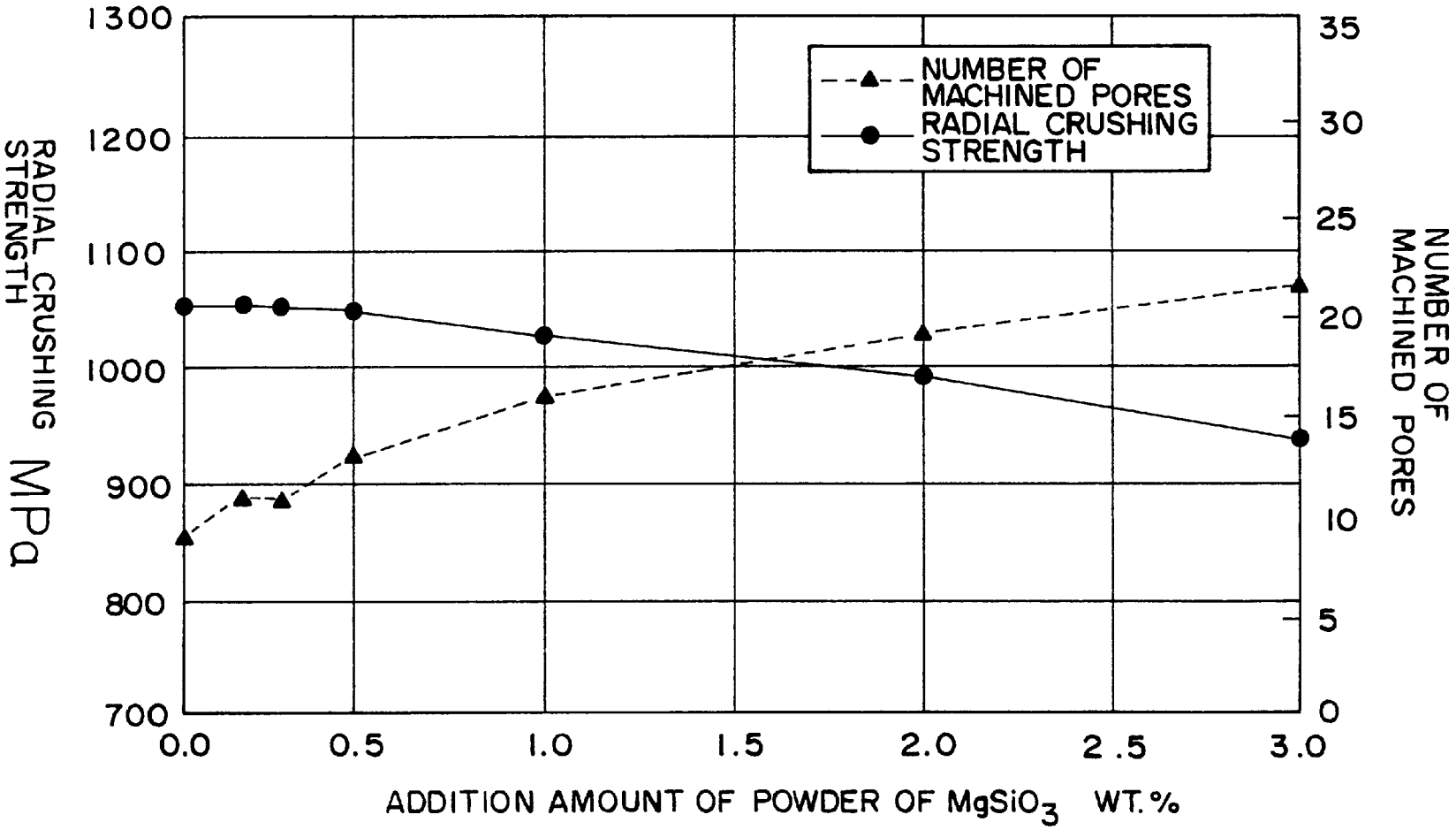

Next, by comparing the sample No. 11, 63 to 66, 73, and 74 of Table 6 and Table 7, it is checked how the addition amounts of the $MgSiO_3$ powders affect. The test results are shown in FIG. 12 together with the total amounts of wear of the conventional sintered alloys of the sample No. 49 and 50. It is known that although the machinability is improved under the effect of the $MgSiO_3$ particles dispersed in the matrix in accordance with the increase of the addition amounts of $MgSiO_3$ powders, the diffusion of the powders is interrupted by the $MgSiO_3$ powders during the sintering and as a result, the strength of the matrix is lowered and the radial crushing strength is lowered, too, as shown in FIG. 11(*b*). Further, as shown in FIG. 11(*a*), the wear amounts of the valve seats are small although it is slightly increased and exhibit favorable wear resistance until the addition amounts of the $MgSiO_3$ powders reach 2.0% by weight. When the addition amounts exceed 2.0% by weight, the wear amounts are increased under the effect of the lowering of the strength of the matrix. From this, it is known that the machinability can be improved within the limit that the strength and wear resistance are not sacrificed, when the addition amounts of the $MgSiO_3$ powders are 2.0% by weight or less.

Figure 13A:
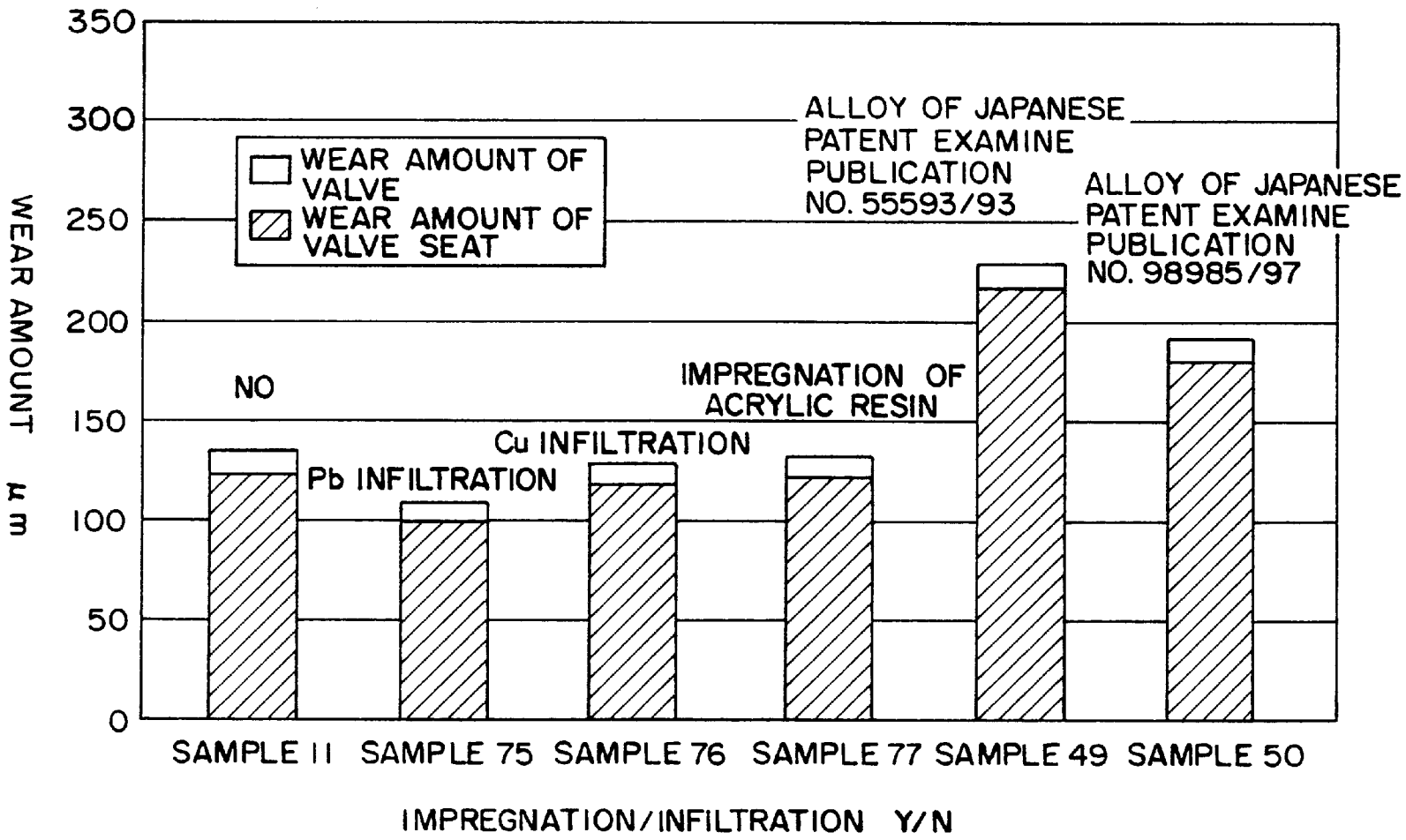
FIG. 13 is a chart showing how the infiltration or impregnation of lead, copper, and acrylic resin affects the characteristics, in the embodiment of the present invention.
Figure 13B:
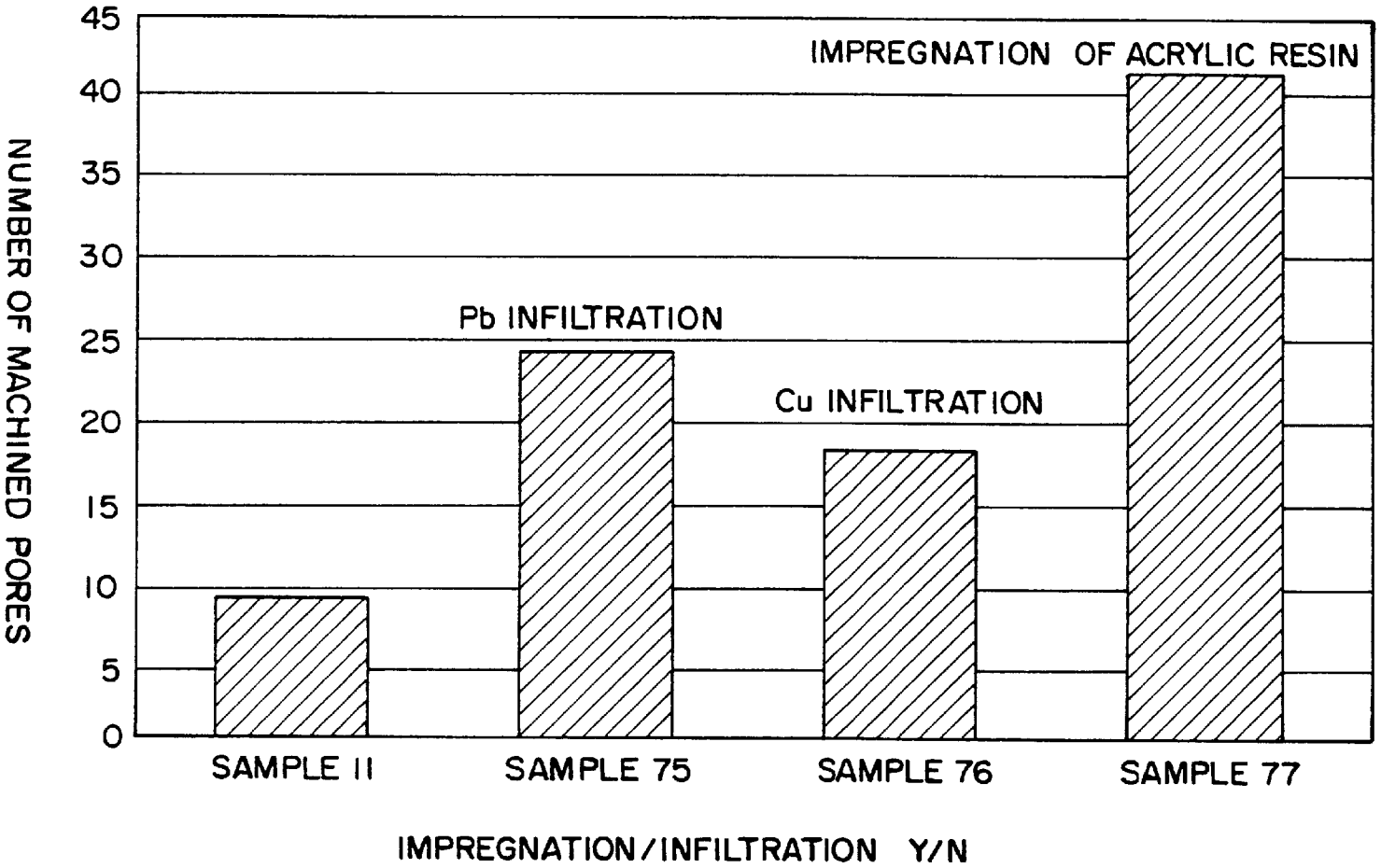

Next, by comparing the sample No. 11, and 75 to 77 of Table 6 and Table 7, it is checked how the infiltration or impregnation of the lead, etc. affects. The test results are shown in FIG. 13 together with the conventional sintered alloys of the sample No. 49 and 50. As shown in FIG. 13, it is known that by having the lead, the copper, and the acrylic resin infiltrate or impregnate, the wear resistance is almost as good as or better than the case where no infiltration or impregnation is effected and that the machinability can be improved extensively while maintaining the superb wear resistance.

Evaluation Test 3

Next, the sintered alloy of the present invention of the sample No. 11 of Table 4 is dipped into a liquid nitrogen immediately after sintering, then picked up after fifteen (15) minutes, and then subjected to subzero treatment. A comparison of this alloy (sample No. 78) with an alloy, which is not subjected to subzero treatment, of the present invention of the sample No. 11 is shown in Table 9. As apparent from this Table 9, it is known that by applying a subzero treatment to an alloy, the strength of the alloy can be increased and in addition, the wear resistance of the alloy can be further improved.

It should be noted that the sintered alloy having superb wear resistance according to the present invention is not limited to the valve seats as in the above embodiment but it can be likewise applied to various parts which are required to have superb wear resistance.

As described hereinbefore, in a sintered alloy having superb wear resistance and a process for producing the same, there can be provided a higher wear resistance than the conventional techniques as a sintered alloy for valve seats of internal combustion engines. Furthermore, by applying manganese sulfide powder, lead powder, boron nitride powder, or meta-magnesium silicate metal powder, or by infiltrating or impregnating lead, acrylic resin, copper or copper alloy, the machinability can be improved while maintaining a favorable wear resistance.

What is claimed is:

1. A sintered alloy having superb wear resistance consisting, percent by weight of, as a whole:

Ni in the amount of 1.35 to 19.61%;

Cr in the amount of 0.9 to 11.05%;

Mo in the amount of 1.44 to 9.09%;

Co in the amount of 3.6 to 20.05%;

V in the amount of 0.018 to 0.26%;

Si in the amount of 0.1 to 0.75%;

C in the amount of 0.35 to 1.5%; and the balance of Fe; and said sintered alloy exhibiting a metallographic structure in which the following hard phases are dispersed in a mixed structure of martensite, sorbite, and austenite:

a first hard phase comprising, a hard phase as a core mainly consisting of Mo suicide, and a diffused phase including diffused Co surrounding the hard phase; and a second hard phase comprising, a hard phase as a core consisting of Cr carbide, and a mixed phase of ferrite and austenite surrounding the hard phase.

2. A sintered alloy having superb wear resistance consisting, percent by weight of, as a whole:

Ni in the amount of 1.35 to 19.61%;

Cr in the amount of 0.9 to 11.05%;

Mo in the amount of 1.44 to 9.42%;

Co in the amount of 3.6 to 20.05%;

V in the amount of 0.018 to 0.85%;

W in the amount of 0 to 1.50%;

Si in the amount of 0.1 to 0.75%;

C in the amount of 0.35 to 1.5%; and the balance of Fe; and said sintered alloy exhibiting a metallographic structure in which the following hard phases are dispersed in a mixed structure of martensite, sorbite, and austenite:

a first hard phase comprising, a hard phase as a core mainly consisting of Mo suicide, and a diffused phase including diffused Co surrounding the hard phase; and a second hard phase comprising, a hard phase as a core mainly consisting of Cr carbide, and a mixed phase of ferrite and austenite surrounding the hard phase.

3. The sintered alloy having superb wear resistance according to claim 1, wherein pores formed in said sintered alloy contain lead, acrylic resin, or copper or copper alloy.

4. The sintered alloy having superb wear resistance according to claim 2, wherein pores formed in said sintered alloy contain lead, acrylic resin, or copper or copper alloy.

5. The sintered alloy having superb wear resistance according to claim 3, wherein at least one of lead, manganese sulfide, boron nitride, and meta-magnesium silicate metal is dispersed in the amount of 0.3 to 2.0% by weight in said metallographic structure.

6. The sintered alloy having superb wear resistance according to claim 4, wherein at least one of lead, manganese sulfide, boron nitride, and meta-magnesium silicate metal is dispersed in the amount of 0.3 to 2.0% by weight in said metallographic structure.

7. A process for producing a sintered alloy having superb wear resistance comprising:

preparing the following alloy powders,

A alloy powder consisting, percent by weight, of Cr in the amount of 2 to 4%, Mo in the amount of 0.2 to 0.4%, V in the amount of 0.2 to 0.4%, and the balance of Fe;

B alloy powder consisting, percent by weight, of Ni in the amount of 3% or less, Mo in the amount of 0.5 to 3%, Co in the amount of 5.5 to 7.5%, and the balance of Fe;

C alloy powder consisting, percent by weight, of Mo in the amount of 26 to 30%, Cr in the amount of 7 to 9%, Si in the amount of 2 to 3%, and the balance of Co; and D alloy powder consisting, percent by weight, of Cr in the amount of 4 to 25%, C in the amount of 0.25 to 2.4%, and the balance of Fe;

adding, percent by weight, a Ni powder in the amount of 3 to 20%, and a graphite powder in the amount of 0.6 to 1.2% to said A alloy powder and said B alloy powder whose mutual weight ratio is 25:75 to 75:25 so as to be turned into a preliminarily mixed powder (said weight ratio is with respect to said preliminarily mixed powder as a whole);

providing a mixed powder obtained by adding said C alloy powder in the amount of 5 to 25% by weight, and said D alloy powder in the amount of 5 to 30% by weight to said preliminarily mixed powder (said weight ratio is with respect to said mixed powder as a whole); and compacting and sintering the mixed powder to obtain a sinter alloy having superb wear resistance.

8. A process for producing a sintered alloy having superb wear resistance comprising:

preparing the following alloy powders,

A alloy powder consisting, percent by weight, of Cr in the amount of 2 to 4%, Mo in the amount of 0.2 to 0.4%, V in the amount of 0.2 to 0.4%, and the balance of Fe;

B alloy powder consisting, percent by weight, of Ni in the amount of 3% or less, Mo in the amount of 0.5 to 3%, Co in the amount of 5.5 to 7.5%, and the balance of Fe;

C alloy powder consisting, percent by weight, of Mo in the amount of 26 to 30%, Cr in the amount of 7 to 9%, Si in the amount of 2 to 3%, and the balance of Co; and E alloy powder consisting, percent by weight, of Cr in the amount of 4 to 25%, C in the amount of 0.25 to 2.4%, at least one of Mo in the amount of 0.3 to 3%, V in the amount of 0.2 to 2.2%, and W in the amount of 1 to 5%, and the balance of Fe;

adding, percent by weight, a Ni powder in the amount of 3 to 20%, and a graphite powder in the amount of 0.6 to 1.2% to said A alloy powder and said B alloy powder whose mutual weight ratio is 25:75 to 75:25 so as to be turned into a preliminarily mixed powder (said weight ratio is with respect to said preliminarily mixed powder as a whole);

providing a mixed powder obtained by adding said C alloy powder in the amount of 5 to 25% by weight, and said E alloy powder in the amount of 5 to 30% by weight to said preliminarily mixed powder (said weight ratio is with respect to said mixed powder as a whole); and compacting and sintering the mixed powder to obtain a sinter alloy having superb wear resistance.

9. The process for producing a sintered alloy having superb wear resistance according to claim 7, wherein lead, acrylic resin, or copper or copper alloy is infiltrated or impregnated into pores formed in the sintered alloy.

10. The process for producing a sintered alloy having superb wear resistance according to claim 8, wherein lead, acrylic resin, or copper or copper alloy is infiltrated or impregnated into pores formed in the sintered alloy.

11. The process for producing a sintered alloy having superb wear resistance according to claim 9, wherein at least one of a lead powder, a manganese sulfide powder, a boron nitride powder, and a meta-magnesium silicate metal powder is blended in an amount, percent by weight with respect to said mixed power as a whole, of 0.3 to 2.0%, to said mixed powder.

12. The process for producing a sintered alloy having superb wear resistance according to claim 10, wherein at least one of a lead powder, a manganese sulfide powder, a boron nitride powder, and a meta-magnesium silicate metal powder is blended in an amount, percent by weight with respect to said mixed power as a whole, of 0.3 to 2.0%, to said mixed powder.

13. The process for producing a sintered alloy having superb wear resistance according to claim 7, wherein the sintered alloy is further subjected to subzero treatment.

14. The process for producing a sintered alloy having superb wear resistance according to claim 8, wherein the sintered alloy is further subjected to subzero treatment.

15. The process for producing a sintered alloy having superb wear resistance according to claim 9, wherein the sintered alloy is further subjected to subzero treatment.

16. The process for producing a sintered alloy having superb wear resistance according to claim 10, wherein the sintered alloy is further subjected to subzero treatment.

17. The process for producing a sintered alloy having superb wear resistance according to claim 11, wherein the sintered alloy is further subjected to subzero treatment.

18. The process for producing a sintered alloy having superb wear resistance according to claim 12, wherein the sintered alloy is further subjected to subzero treatment.

* * * * *

UNITED STATES PATENT AND TRADEMARK OFFICE

CERTIFICATE OF CORRECTION

PATENT NO. : 5,952,590

DATED : September 14, 1999

INVENTOR(S) : Hideki Kawata, et al.

It is certified that error appears in the above-identified patent and that said Letters Patent is hereby corrected as shown below:

On The Title Page, [57] Abstract, Line 11: "suicide" --silicide--

Column 9, Line 40: "suicide" should read --silicide--

Column 10, Line 2: "suicide" should read --silicide--

Column 11, Line 20: "consist ing" should read --consisting--

Column 13, Line 45: "Win" should read --W in--

Column 19, Line 52: "a re" should read --are--

Column 23, Line 21, Table 5: "144" should read -- -144 --

Column 30, Line 17, Claim 1: "suicide" should read --silicide--

Column 30, Line 39, Claim 2: "suicide" should read --silicide--

Signed and Sealed this

Thirty-first Day of October, 2000

*Attest:*

Q. TODD DICKINSON

*Attesting Officer*

*Director of Patents and Trademarks*